US010053968B2

(12) United States Patent
Tolman et al.

(10) Patent No.: US 10,053,968 B2
(45) Date of Patent: Aug. 21, 2018

(54) METHODS FOR MULTI-ZONE FRACTURE STIMULATION OF A WELL

(71) Applicants: Randy C. Tolman, Spring, TX (US); Pavlin B. Entchev, Stavanger (NO); Timothy I. Morrow, Humble, TX (US)

(72) Inventors: Randy C. Tolman, Spring, TX (US); Pavlin B. Entchev, Stavanger (NO); Timothy I. Morrow, Humble, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 480 days.

(21) Appl. No.: 14/796,807

(22) Filed: Jul. 10, 2015

(65) Prior Publication Data

US 2016/0040520 A1 Feb. 11, 2016

Related U.S. Application Data

(60) Provisional application No. 62/035,282, filed on Aug. 8, 2014.

(51) Int. Cl.
*E21B 43/26* (2006.01)
*E21B 43/116* (2006.01)
(Continued)

(52) U.S. Cl.
CPC ..... *E21B 43/26* (2013.01); *E21B 33/124* (2013.01); *E21B 33/138* (2013.01);
(Continued)

(58) Field of Classification Search
CPC ..... E21B 43/26; E21B 43/119; E21B 43/117; E21B 33/138; E21B 33/124; E21B 43/14; E21B 43/116; E21B 43/267; E21B 47/09
See application file for complete search history.

(56) References Cited

U.S. PATENT DOCUMENTS 4,893,676 A 1/1990 Hill
6,378,627 B1 4/2002 Tubel et al.
(Continued)

FOREIGN PATENT DOCUMENTS

WO WO-2012082304 A2 * 6/2012 ..... E21B 23/00
WO WO 2012/161854 A2 11/2012

OTHER PUBLICATIONS

Higginson, "Comparing Completions," Oilfield Technology, Aug. 2011, Packers Plus Energy Services, UK.
(Continued)

*Primary Examiner* — Michael R Wills, III
(74) *Attorney, Agent, or Firm* — ExxonMobil Upstream Research Company—Law Department

(57) ABSTRACT

A completion assembly designed to perforate a section of casing along a wellbore, comprises a perforating gun, a canister, and a locator device. The canister contains ball sealers that are dimensioned to seal perforations, while the locator device is a casing collar locator that senses the location of the assembly within the wellbore based on the spacing of casing collars. The completion assembly also includes an on-board controller configured to send an actuation signal to the perforating gun to cause one or more detonators to fire when the locator has recognized a selected location of the completion assembly, thereby perforating the casing, and to release the ball sealers from the canister. Methods for seamlessly perforating and fracturing multiple zones along a wellbore are also provided, using a select-fire perforating gun.

21 Claims, 23 Drawing Sheets

(51) Int. Cl.

| | |
|---|---|
| ***E21B 43/267*** | (2006.01) |
| ***E21B 43/119*** | (2006.01) |
| ***E21B 33/124*** | (2006.01) |
| ***E21B 33/138*** | (2006.01) |
| ***E21B 43/117*** | (2006.01) |

(52) U.S. Cl.

CPC ..... *E21B 43/116* (2013.01); *E21B 43/117* (2013.01); *E21B 43/119* (2013.01); *E21B 43/267* (2013.01)

(56) References Cited

U.S. PATENT DOCUMENTS

| | | | | |
|---|---|---|---|---|
| 6,394,184 | B2 | 5/2002 | Tolman et al. | |
| 6,543,538 | B2 | 4/2003 | Tolman et al. | |
| 6,843,317 | B2 | 1/2005 | Mackenzie | |
| 7,059,407 | B2 | 6/2006 | Tolman et al. | |
| 7,278,486 | B2 | 10/2007 | Alba et al. | |
| 7,363,967 | B2 | 4/2008 | Burris, II et al. | |
| 7,385,523 | B2 | 6/2008 | Thomeer et al. | |
| 7,703,507 | B2 | 4/2010 | Strickland | |
| 7,814,970 | B2 | 10/2010 | Strickland | |
| 8,037,934 | B2 | 10/2011 | Strickland | |
| 8,162,051 | B2 | 4/2012 | Strickland | |
| 8,272,439 | B2 | 7/2012 | Strickland | |
| 9,284,819 | B2 * | 3/2016 | Tolman | E21B 23/00 |
| 9,328,578 | B2 * | 5/2016 | Kumaran | E21B 23/00 |
| 9,617,829 | B2 * | 4/2017 | Dale | E21B 23/00 |
| 2005/0241824 | A1 | 11/2005 | Burris et al. | |
| 2008/0066917 | A1 | 3/2008 | Lehr et al. | |
| 2008/0257546 | A1 | 10/2008 | Cresswell et al. | |
| 2009/0101334 | A1 * | 4/2009 | Baser | E21B 33/138 166/193 |
| 2009/0255674 | A1 * | 10/2009 | Boney | E21B 33/138 166/284 |
| 2011/0035152 | A1 | 2/2011 | Durocher et al. | |
| 2013/0062055 | A1 | 3/2013 | Tolman et al. | |
| 2013/0248174 | A1 | 9/2013 | Dale et al. | |
| 2013/0255939 | A1 | 10/2013 | Kumaran et al. | |
| 2014/0131035 | A1 * | 5/2014 | Entchev | E21B 43/263 166/255.1 |

OTHER PUBLICATIONS

Bour et al., "Development of Diverter Systems for EGS and Geothermal Well Stimulation Applications," DOE Grant DE-EE0002795, "Temporary Bridging Agents for Use in Drilling and Completion of Engineered Geothermal Systems," Jan. 2012, Stanford University.

* cited by examiner

Prior Art

Prior Art

Prior Art

Prior Art

Prior Art

Prior Art

Prior Art

Prior Art

Prior Art

METHODS FOR MULTI-ZONE FRACTURE STIMULATION OF A WELL

CROSS REFERENCE TO RELATED APPLICATIONS

This application claims the benefit of U.S. Provisional Patent Application 62/035,282 filed Aug. 8, 2014 entitled "Methods for Multi-Zone Fracture Stimulation of a Well", the entirety of which is incorporated by reference herein. This application is related to U.S. application Ser. No. 13/989,728, filed Nov. 17, 2011, titled "Automatic Downhole Conveyance System", and U.S. application Ser. No. 13/697,769, filed May 26, 2011, titled "Assembly and Method for Multi-Zone Fracture Stimulation of a Reservoir Using Autonomous Tubular Units". Both applications are incorporated herein by reference in their entirety.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field Of The Invention

This invention relates generally to the field of wellbore operations. More specifically, the invention relates to completion processes wherein multiple zones of a formation are fractured along a wellbore in a seamless manner.

General Discussion Of Technology

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the surrounding formations.

A cementing operation is typically conducted in order to fill or "squeeze" the annular area with columns of cement. The combination of cement and casing strengthens the wellbore and facilitates the zonal isolation of the formations behind the casing.

It is common to place several strings of casing having progressively smaller outer diameters into the wellbore. A first string may be referred to as surface casing. The surface casing serves to isolate and protect the shallower, fresh water-bearing aquifers from contamination by any other wellbore fluids. Accordingly, this casing string is almost always cemented entirely back to the surface.

The process of drilling and then cementing progressively smaller strings of casing is repeated several times until the well has reached total depth. In some instances, the final string of casing is a liner, that is, a string of casing that is not tied back to the surface. The final string of casing, referred to as a production casing, is also typically cemented into place. In some completions, the production casing (or liner) has swell packers spaced across the productive interval. This creates compartments between the swell packers for isolation of zones and specific stimulation treatments.

As part of the completion process, the production casing is perforated at a desired level. This means that lateral holes are shot through the casing and the cement column surrounding the casing. The perforations allow reservoir fluids to flow into the wellbore. Thereafter, the formation is typically fractured. In the case of swell packers or individual compartments, the perforating gun penetrates the casing, allowing reservoir fluids to flow from the rock formation into the wellbore along an individual zone.

Hydraulic fracturing consists of injecting water with friction reducers or viscous fluids (usually shear thinning, non-Newtonian gels or emulsions) into a formation at such high pressures and rates that the reservoir rock parts and forms a network of fractures. The fracturing fluid is typically mixed with a proppant material such as sand, ceramic beads, or other granular materials. The proppant serves to hold the fracture(s) open after the hydraulic pressures are released. In the case of so-called "tight" or unconventional formations, the combination of fractures and injected proppant substantially increases the flow capacity of the treated reservoir.

In order to further stimulate the formation and to clean the near-wellbore regions downhole, an operator may choose to "acidize" the formations. This is done by injecting an acid solution down the wellbore and through the perforations. The use of an acidizing solution is particularly beneficial when the formation comprises carbonate rock. In operation, the completion company injects a concentrated formic acid or other acidic composition into the wellbore, and directs the fluid into selected zones of interest. The acid helps to dissolve carbonate material, thereby opening up porous channels through which hydrocarbon fluids may flow into the wellbore. In addition, the acid helps to dissolve drilling mud that may have invaded the formation.

Application of hydraulic fracturing and acid stimulation as described above is a routine part of petroleum industry operations as applied to individual hydrocarbon-producing formations (or "pay zones"). Such pay zones may represent up to about 60 meters (100 feet) of gross, vertical thickness of subterranean formation. More recently, wells are being completed through a producing formation horizontally, with the horizontal portion extending possibly 5,000, 10,000 or even 15,000 feet.

When there are multiple or layered formations to be hydraulically fractured, or a very thick hydrocarbon-bearing formation (over about 40 meters, or 131 feet), or where an extended-reach horizontal well is being completed, then more complex treatment techniques are required to obtain treatment of the entire target formation. In this respect, the operating company must isolate various zones or sections to ensure that each separate zone is not only perforated, but adequately fractured and treated. In this way the operator is sure that fracturing fluid and proppant are being injected through each set of perforations and into each zone of interest to effectively increase the flow capacity at each desired depth.

The isolation of various zones for pre-production treatment requires that the intervals be treated in stages. This, in turn, involves the use of so-called diversion methods. In petroleum industry terminology, "diversion" means that injected fluid is diverted from entering one set of perforations so that the fluid primarily enters only one selected zone of interest. Where multiple zones of interest are to be perforated, this requires that multiple stages of diversion be carried out.

In order to isolate selected zones of interest, various diversion techniques may be employed within the wellbore. Known diversion techniques include the use of:

- Mechanical devices such as bridge plugs, packers, downhole valves, sliding sleeves (known as "frac sleeves"), and baffle/plug combinations;
- Ball sealers;
- Particulates such as sand, ceramic material, proppant, salt, waxes, resins, or other compounds;

Chemical systems such as viscosified fluids, gelled fluids, foams, or other chemically formulated fluids; and Limited entry methods.

These and other methods for temporarily blocking the flow of fluids into or out of a given set of perforations are described more fully in U.S. Pat. No. 6,394,184 entitled "Method and Apparatus for Stimulation of Multiple Formation Intervals." The '184 patent issued in 2002 and is referred to and incorporated herein by reference in its entirety.

The '184 patent also discloses various techniques for running a bottom hole assembly ("BHA") into a wellbore, and then creating fluid communication between the wellbore and various zones of interest. In most embodiments, the BHA includes various perforating guns having associated charges. In most embodiments, the BHA is deployed in the wellbore by means of a wireline extending from the surface. The wireline provides electrical signals to the surface for depth control. It also provides electrical signals to the perforating guns for detonation. The electrical signals allow the operator to cause the charges to detonate, at the correct depth or zone, thereby forming perforations.

The BHA also includes a set of mechanically actuated, axial position locking devices, or slips. The slips are actuated through a "continuous J" mechanism by cycling the axial load between compression and tension. In this way, the slips are re-settable.

The BHA further includes an inflatable packer or other sealing mechanism. The packer is actuated by application of a slight compressive load after the slips are set within the casing. Along with the slips, the packer is resettable so that the BHA may be moved to different depths or locations along the wellbore so as to isolate perforations along selected zones of interest.

Each of the various embodiments for a BHA disclosed in the '184 patent includes a means for deploying the assembly into the wellbore, and then translating the assembly up and down the wellbore. Such translation means include a string of coiled tubing, conventional jointed tubing, a wireline, an electric line or a tractor system attached directly to the BHA. In any instance, the purpose of the bottom hole assembly is to allow the operator to perforate the casing along various zones of interest, and then sequentially isolate the respective zones of interest so that fracturing fluid may be injected into the zones of interest in the same trip.

The bottom hole assembly and the formation treating processes disclosed in the '184 patent help to expedite the well completion process. In this respect, the operator is able to selectively set the slips and the packer for perforation and subsequent formation treatment. The operator is able to set the BHA at a first location, fracture or otherwise stimulate a formation, release the BHA, and move it to a new level along the wellbore, all without removing the BHA from the wellbore between stages.

The bottom hole assembly and the formation treating processes disclosed in the '184 patent represent a valuable advance in the art of well completion processes. This process is named "Annular Coiled Tubing FRACturing (ACT-Frac). The ACT-Frac process allows the operator to more effectively stimulate multi-layer hydrocarbon formations at substantially reduced cost compared to previous completion methods.

However, as with previously-known well completion processes, the ACT-Frac process requires the use of expensive surface equipment. Such equipment may include a snubbing unit or a lubricator, which may extend as much as 75 feet above the wellhead. In this respect, the snubbing unit or the lubricator must be of a length greater than the length of the perforating gun assembly (or other tool string) to allow the perforating gun assembly to be safely deployed and removed from the wellbore under pressure. An illustrative lubricator and associated crane arm, wellhead and wellbore are shown in FIG. 1 of co-pending patent application U.S. Patent Publ. No. 2013/0255939. FIG. 1 and the related textual description are incorporated herein by reference.

To avoid the need for a long snubbing unit, it is desirable to fracture the multi-zone formation without the use of a long tool string. Further, it is desirable to complete the well in a multi-zone formation using autonomous perforating guns and ball sealers. Alternatively, it is desirable to perforate a well along multiple zones in a seamless manner using a perforating gun having multiple charges, and using ball sealers.

SUMMARY OF THE INVENTION

The assemblies described herein have various benefits in the conducting of oil and gas exploration and production activities.

A completion assembly for autonomously perforating a section of casing in a wellbore is first disclosed. The assembly is an elongated tool that is configured to be released into a wellbore that has one or more strings of casing placed therein.

The completion assembly includes a perforating gun. The perforating gun includes one or more sets of charges that fire upon receiving a detonation signal.

The completion assembly further includes a canister. The canister holds a plurality of ball sealers, each of which is dimensioned to seal perforations. In one aspect, the canister is also a fluid container that holds a fluid along with the ball sealers.

The completion assembly next includes a casing collar locator. The casing collar locater is used to sense the location of the perforating gun within the wellbore based on the spacing of casing collars. The casing collar locator identifies collars by detecting magnetic anomalies along a casing wall.

The completion assembly further includes an on-board controller. Preferably, the on-board controller is part of an electronics module comprising onboard memory and built-in logic. The on-board controller is configured to send a first actuation signal to the canister to release the ball sealers when the locator has recognized a first selected location of the completion assembly. The on-board controller is further configured to send a second actuation signal to the perforating gun to cause one or more detonators to fire when the locator has recognized a second selected location of the completion assembly. In this way, the casing is perforated at the second selected location.

Preferably, the first and second actuation signals are the same signal. When the completion assembly has reached the first selected location, the signal causes a "cap" to be fired. This ignites a primer cord, which in turn shoots the perforating gun and also releases the ball sealers. The charge is designed to fragment the entire tool assembly into the smallest pieces possible. Hence, ball sealers are released as part of the fragmentation.

The first location and the second location may be different locations. In this instance, the controller is programmed to send the first actuation signal before the second actuation signal. Alternatively, the first location and the second location may be substantially the same location. In this instance, the controller is programmed to send the first actuation signal and the second actuation signal at substantially the same times.

Preferably, the canister is fabricated from a friable material. The canister is then designed to self-destruct in response to the second actuation signal sent to the perforating gun. Alternatively, the canister is designed to self-destruct in response to the first actuation signal such that destruction of the canister causes the release of the ball sealers.

In one aspect, the assembly additionally includes a battery pack. The battery pack provides power to the locator and the on-board controller. In this way, the completion assembly may be released from the surface without need of an electric line.

The assembly may also include a safety system. The safety system is a multi-gated system that prevents premature activation of the perforating gun. In this respect, the safety system comprises control circuitry having one or more electrical switches that are independently operated in response to separate conditions before permitting the second actuation signal to reach the tool.

It is observed that the perforating gun, the canister, the locator, and the on-board controller are together dimensioned and arranged to be deployed in the wellbore as an autonomous unit. In this application, "autonomous unit" means that the assembly is not immediately controlled from the surface. Stated another way, the tool assembly does not rely upon a signal from the surface to know when to activate the tool. Preferably, the tool assembly is released into the wellbore without a working line. The tool assembly either falls gravitationally into the wellbore, or is pumped downhole. However, a non-electric working line such as slickline may optionally be employed.

A method for perforating multiple zones along a wellbore is also provided herein. The wellbore has been completed with one or more strings of casing.

The method first includes releasing a first completion assembly into the wellbore. The first completion assembly is designed in accordance with the completion assembly for autonomously perforating a section of casing as described above. In this respect, the assembly includes a perforating gun, a canister containing a plurality of ball sealers, a casing collar locator, and an on-board computer. The on-board controller is configured to send an actuation signal that ultimately causes the perforating gun to fire when the completion assembly has reached a selected location. In this way, the casing is perforated along a second zone in the wellbore. Firing of the perforating gun also preferably is accompanied by a destruction of the entire assembly. This causes the canister to simultaneously release the ball sealers into the wellbore. The ball sealers fall into the wellbore and seal perforations existing in a first zone below the second zone.

The perforating gun, the canister, the locator, and the on-board controller are together dimensioned and arranged to be deployed in the wellbore as a first autonomous unit.

The method also includes pumping a fracturing fluid into the wellbore behind the completion assembly. The method then includes further pumping the fracturing fluid through the perforations in the second zone, thereby creating fractures in a surrounding formation. Preferably, the fracturing fluid comprises a proppant such as sand.

In one aspect, the fracturing fluid begins to be pumped into the wellbore before the first actuation signal is sent to the canister of the first completion assembly. This expedites the completion process.

In one embodiment, the method also includes the steps of:

releasing a second completion assembly into the wellbore;

sealing the perforations in the second zone using ball sealers;

pumping a fracturing fluid into the wellbore behind the second completion assembly;

perforating a third zone above the second zone; and further pumping the fracturing fluid through the perforations in the third zone, thereby creating additional fractures in a surrounding formation.

In this instance, the second completion assembly also includes a perforating gun, a canister containing a plurality of ball sealers that are dimensioned to seal perforations, a casing collar locator for sensing the location of the perforating gun within the wellbore based on the spacing of casing collars along the wellbore, and an on-board controller. Here, the on-board computer is configured to (i) send a first actuation signal to the canister to release the ball sealers when the locator has recognized a third selected location of the completion assembly, wherein the ball sealers then seal perforations existing in the second zone below the third selected location, and (ii) send a second actuation signal to the perforating gun to cause one or more detonators to fire when the locator has recognized a fourth selected location of the completion assembly, thereby perforating the casing at the fourth selected location as a third zone.

Preferably, the fracturing fluid begins to be pumped into the wellbore before the first actuation signal is sent to the canister of the second completion assembly. Preferably, the canister of each of the first and second completion assemblies is fabricated from a friable material. The canisters are then designed to self-destruct in response to the second actuation signal sent to the respective perforating guns. Alternatively, the canisters are designed to self-destruct in response to the first actuation signals such that destruction of the respective canisters causes the release of the respective ball sealers.

In one embodiment of the method, the method further comprises placing a plug in the wellbore below the first zone before releasing the first completion assembly.

In one arrangement, a packer (or swell packer) resides between the first zone and the second zone. This serves to seal an annular region between the casing and a surrounding earth formation. The process of pumping proppant through the perforations formed in the first zone creates a sand pack in the annular region below the packer.

A separate method for perforating multiple zones along a wellbore is also provided herein. The wellbore has again been completed with one or more strings of casing. This second method involves the use of an electric line.

The method first includes lowering a first perforating gun into the wellbore. The gun is lowered on a wireline. The method then includes the following steps:

sending an electrical signal down the wireline to detonate charges associated with the first perforating gun, thereby perforating the casing at a first zone;

pumping a fracturing fluid into the wellbore a first time behind and past the first perforating gun;

further pumping the fracturing fluid through the perforations in the first zone, thereby creating fractures in a surrounding earth formation along the first zone;

releasing ball sealers into the wellbore after beginning to pump the fracturing fluid into the wellbore the first time, thereby sealing the perforations in the first zone;

perforating the casing at a second zone that is above the first zone;

pumping a fracturing fluid into the wellbore through the perforations in the second zone, thereby creating additional fractures in the surrounding earth formation along the second zone; and releasing ball sealers into the wellbore after beginning to pump the fracturing fluid into the wellbore the second time, thereby sealing the perforations in the second zone.

Preferably, the fracturing fluid comprises a proppant such as sand.

In one aspect, perforating the casing at a second zone comprises lowering a second perforating gun into the wellbore on a wireline, and then sending an electrical signal down the wireline to detonate charges associated with the second perforating gun, thereby perforating the casing at the second zone. In another aspect, the first perforating gun comprises at least a first set of charges and a second set of charges. The first perforating zone is perforated using the first set of charges. In this instance, perforating the casing at a second zone comprises pulling the wireline, thereby raising the first perforating gun in the wellbore to the second zone, and then sending an electrical signal down the wireline to detonate the second set of charges, thereby perforating the casing at the second zone. Preferably, select fire perforating guns are employed that allow a string of independent guns to be run into the well on the wireline. Ten to 15 guns may be run on a single trip.

In one embodiment, the method further comprises dropping a ball into the wellbore after perforating the casing at the second zone and removing the wireline, and then applying hydraulic pressure in the wellbore. This causes a fracturing sleeve located in the wellbore in a third zone that is above the second zone to open. The method then includes pumping a fracturing fluid into the wellbore a third time through the fracturing sleeve, thereby creating fractures in the surrounding earth formation along the third zone.

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

FIG. 1A presents a wellbore having been lined with a string of production casing. Annular packers are placed along the wellbore to isolate selected subsurface zones. The zones are identified as "A," "B" and "C."

FIG. 1B shows Zone A having been perforated. Further, fractures have been formed in the subsurface formation along Zone A using any known hydraulic fracturing technique.

FIG. 1C shows that a plug has been set adjacent a packer intermediate Zones A and B. Further, a perforating gun is shown forming perforations along Zone B.

FIG. 1D shows that a fracturing fluid being pumped into the wellbore, with artificial fractures being induced in the subsurface formation along Zone B.

FIG. 1E shows that ball sealers have been dropped into the wellbore, thereby sealing perforations along Zone B. Further, a perforating gun is now indicated along Zone C. The casing along Zone C has been perforated.

FIG. 1F shows fracturing fluid being pumped into the wellbore. Artificial fractures have been induced in the subsurface formation along Zone C.

FIG. 2A presents a wellbore having been lined with a string of production casing. Annular packers are placed along the wellbore to isolate selected subsurface zones. The zones are identified as "A," "B" and "C."

FIG. 2B shows Zone A having been perforated using a perforating gun. A plug has been run into the wellbore with the perforating gun.

FIG. 2C shows that fractures have been formed in the subsurface formation along Zone A using a fracturing fluid. Proppant is seen residing now in an annular region along Zone A.

FIG. 2D shows that a second plug has been set adjacent a packer intermediate Zones B and C. Further, a perforating gun is shown forming perforations along Zone B.

FIG. 2E shows that fracturing fluid being pumped into the wellbore, with artificial fractures being induced in the subsurface formation along Zone B.

FIG. 2F shows that a third plug has been set adjacent a packer intermediate Zones B and C. Further, a perforating gun is shown forming perforations along Zone C.

FIG. 3A presents a wellbore having been lined with a string of production casing. Annular packers are placed along the wellbore to isolate selected subsurface zones. The zones are identified as "A," "B" and "C."

FIG. 3B shows that a ball has been dropped onto a fracturing sleeve in Zone A.

FIG. 3C shows that hydraulic pressure has been applied to open the fracturing sleeve in Zone A by pumping a fracturing fluid into the wellbore. Further, fractures are being induced in the subsurface formation along Zone A. Proppant is seen residing now in an annular region along Zone A.

FIG. 3D shows that a second ball has been dropped. The ball has landed on a fracturing sleeve in Zone B.

FIG. 3E shows that hydraulic pressure has been applied to open the fracturing sleeve in Zone B by pumping a fracturing fluid into the wellbore. Further, fractures are being induced in the subsurface formation along Zone B. Proppant is seen residing now in an annular region along Zone B.

FIG. 3F shows that a third ball has been dropped. The ball has landed on a fracturing sleeve in Zone C. Zone C is ready for treatment.

FIG. 4A presents a wellbore having been lined with a string of production casing. Annular packers are placed along the wellbore to isolate selected subsurface zones. The zones are again identified as "A," "B" and "C."

FIG. 4B shows Zone A having received a perforating gun. A plug has been run into the wellbore with the perforating gun. Zone A has been perforated.

FIG. 4C shows that fractures are being formed in the subsurface formation along Zone A using a fracturing fluid. Proppant is seen residing now in an annular region along Zone A. Additionally, ball sealers and a perforating gun are being simultaneously run into the wellbore in anticipation of treating Zone B.

FIG. 4D shows that the perforating gun of FIG. 4C has been placed along Zone B. Fractures have been formed in Zone B. Simultaneously, a fracturing fluid is being pumped into the wellbore behind the perforating gun.

FIG. 4E shows that the fracturing fluid of FIG. 4D is now being pumped through perforations formed in Zone B. Artificial fractures are being induced along Zone B. Simultaneously, ball sealers have been dropped into the wellbore above the fracturing fluid.

FIG. 4F shows fracturing fluid having been pumped through the perforations along Zone B. The ball sealers from FIG. 4E are placed along the perforations. Behind the ball sealers, and after removal of the wireline, a ball has been dropped onto a fracturing sleeve along Zone C, with new fracturing fluid being pumped behind the ball.

FIG. 6A presents a wellbore having been lined with a string of production casing. Annular packers are placed along the wellbore to isolate selected subsurface zones. The zones are identified as "A," "B" and "C." An autonomous perforating gun has been dropped into the wellbore.

FIG. 6B shows Zone A having received the autonomous perforating gun. The perforating gun includes a plug as part of a perforating assembly. The plug has been set autonomously adjacent a packer below Zone A.

FIG. 6C shows Zone A having been perforated. The autonomous perforating gun has disintegrated and is no longer visible. Simultaneously, a fracturing fluid is being pumped into the wellbore, with a new autonomous perforating gun being released into the wellbore behind the fracturing fluid.

FIG. 6D shows the fracturing fluid having been pumped through the perforations in Zone A. Artificial fractures have been induced in the subsurface formation along Zone A. Simultaneously, the autonomous perforating gun of FIG. 6C has fallen to a location along Zone B.

FIG. 6E shows that ball sealers have landed in the perforations along Zone A. Additionally, the perforating gun of FIG. 6D has fired, creating fractures along Zone B. A new fracturing fluid is now being pumped in the wellbore in anticipation of treating Zone B. The perforating gun of FIG. 6D has disintegrated.

FIG. 6F shows the fracturing fluid of FIG. 6E now being pumped into the perforations along Zone B. Artificial fractures are being formed along Zone B. Simultaneously, a new autonomous fracturing gun has been released into the wellbore in anticipation of creating perforations along Zone C.

DETAILED DESCRIPTION OF CERTAIN EMBODIMENTS

Definitions

Figure 1A:
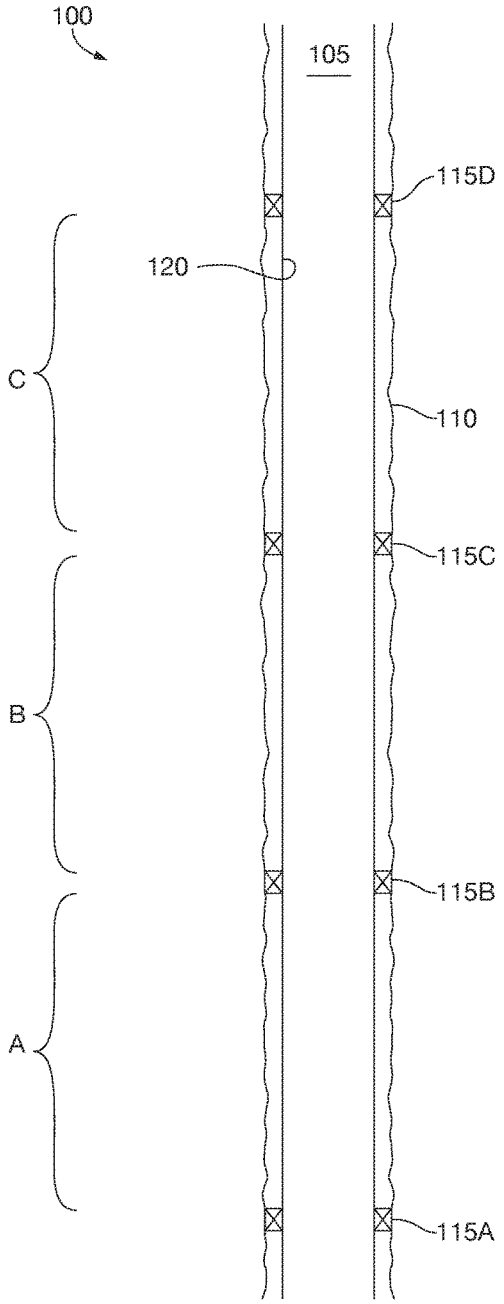
FIGS. 1A through 1F present a series of side views of a lower portion of a wellbore. The wellbore is undergoing a completion procedure that uses perforating guns and ball sealers in stages. This is a known procedure.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. to 20° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, carbon dioxide, hydrogen sulfide and water (including steam).

As used herein, the term "fluid" refers to gases, liquids, and combinations of gases and liquids, as well as to combinations of gases and solids, combinations of liquids and solids, and combinations of gases, liquids, and solids.

As used herein, the term "gas" refers to a fluid that is in its vapor phase at 1 atm and 15° C.

As used herein, the term "oil" refers to a hydrocarbon fluid containing primarily a mixture of condensable hydrocarbons.

As used herein, the term "subsurface" refers to geologic strata occurring below the earth's surface.

As used herein, the term "formation" refers to any definable subsurface region. The formation may contain one or more hydrocarbon-containing layers, one or more non-hydrocarbon containing layers, an overburden, and/or an underburden of any geologic formation.

The terms "zone" or "zone of interest" refers to a portion of a formation containing hydrocarbons. Alternatively, the formation may be a water-bearing interval.

For purposes of the present patent, the term "production casing" includes a liner string or any other tubular body fixed in a wellbore along a zone of interest, which may or may not extend to the surface.

The term "friable" means any material that is easily crumbled, powderized, or broken into very small pieces. The term "friable" includes frangible materials such as ceramic.

As used herein, the term "wellbore" refers to a hole in the subsurface made by drilling or insertion of a conduit into the subsurface. A wellbore may have a substantially circular cross section, or other cross-sectional shapes. As used herein, the term "well," when referring to an opening in the formation, may be used interchangeably with the term "wellbore."

Description Of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

Wellbore completions in unconventional reservoirs are increasing in length. Whether such wellbores are vertical or horizontal, such wells require the placement of multiple perforation sets and multiple fractures. Known completions, in turn, require the addition of downhole hardware which increases the expense, complexity and risk of such completions.

Several techniques are known for fracturing multiple zones along an extended wellbore incident to hydrocarbon production operations. One such technique recently developed involves the use of perforating guns and ball sealers run in stages.

FIGS. 1A through 1F present a series of side views of a lower portion of an extended wellbore 100. The wellbore 100 is undergoing a completion procedure that uses perforating guns 150 and ball sealers 160 in stages.

First, FIG. 1A introduces the wellbore 100. The wellbore 100 is lined with a string of production casing 120. The production casing 120 defines a long series of pipe joints that are threadedly coupled, end-to-end. The production casing 120 provides a bore 105 for the transport of fluids into the wellbore 100 and out of the wellbore 100.

The production casing 120 resides within a surrounding subsurface formation 110. Annular packers are placed along the casing 120 to isolate selected subsurface zones. Three illustrative zones are shown in the FIG. 1 series, identified as "A," "B" and "C." The packers, in turn, are designated as 115A, 115B, 115C and 115D, and are generally placed intermediate the zones.

Figure 1B:
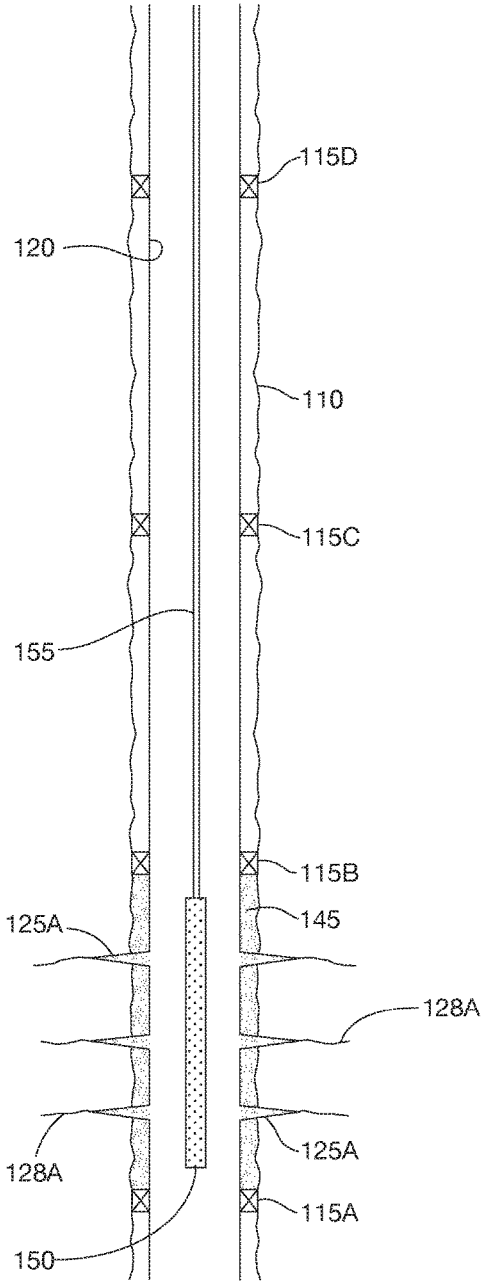

It is desirable to perforate and fracture the formation along each of Zones A, B and C. FIG. 1B shows Zone A having been perforated. Perforations 125A are placed by detonating charges associated with a perforating gun 150. Further, fractures 128A have been formed in the subsurface formation 110 along Zone A. The fractures 128A are formed using any known hydraulic fracturing technique.

It is observed that in connection with the formation of the fractures 128A, a hydraulic fluid 145 having a proppant is used. The proppant is typically sand, and is used to keep the fractures 128A open after hydraulic pressure is released from the formation 110. It is also observed that after the injection of the hydraulic fluid 145, a thin annular gravel pack is left in the region formed between the casing 120 and the surrounding formation 110. This is seen between packers 115A and 115B. The gravel pack beneficially supports the surrounding formation 110 and helps keeps fines from invading the bore 105.

Figure 1C:
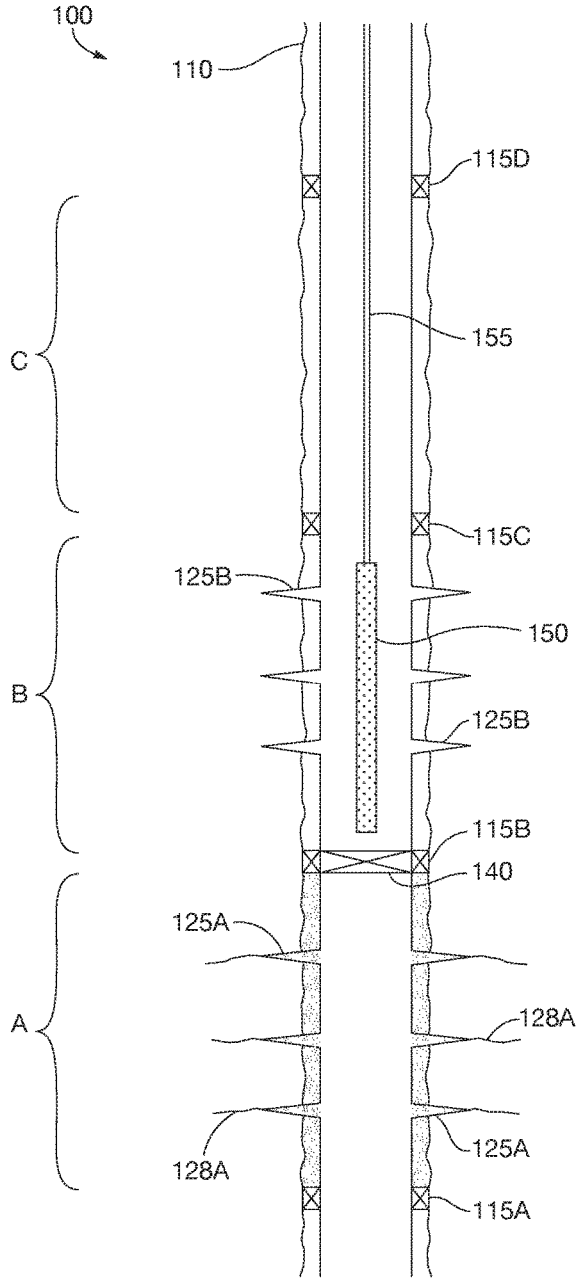

As a next step, Zone B is fractured. This is shown in FIG. 1C. FIG. 1C shows that a plug 140 has been set adjacent the packer 115B intermediate Zones A and B. Further, the perforating gun 150 has been placed along Zone B. Additional charges associated with the perforating gun 150 are detonated, producing perforations 125B.

Figure 1D:
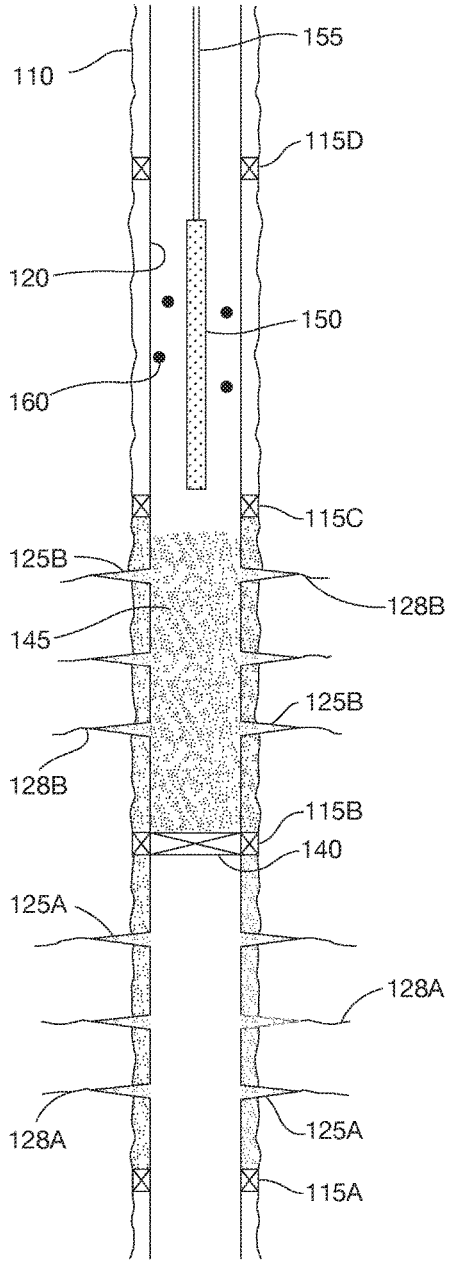

Next, FIG. 1D shows that a fracturing fluid 145 is being pumped into the bore 105. Artificial fractures 128B are being formed in the subsurface formation 110 along Zone B. In addition, a new perforating gun 150 has been lowered into the wellbore 100 and placed along Zone C.

Figure 1E:
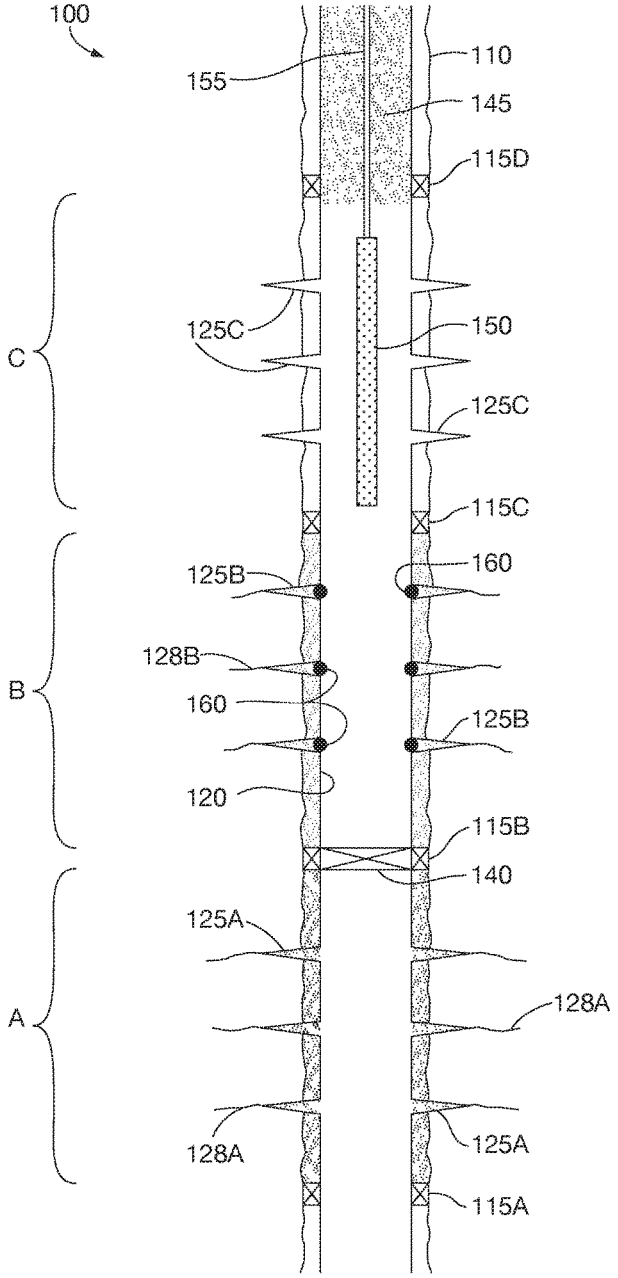

FIG. 1E shows a next step in the completion of the multi-zone wellbore 100. In FIG. 1E, ball sealers 160 have been dropped into the wellbore and have landed along Zone B. The ball sealers 160 seal the perforations 125B along Zone B.

It is also observed in FIG. 1E that the perforating gun 150 has been raised in the wellbore 100 up to Zone C. Remaining charges associated with the perforating gun 150 are detonated, producing new perforations 125C. After perforating, a fracturing fluid 145 is pumped into the bore 105 behind the perforating gun 150.

Figure 1F:
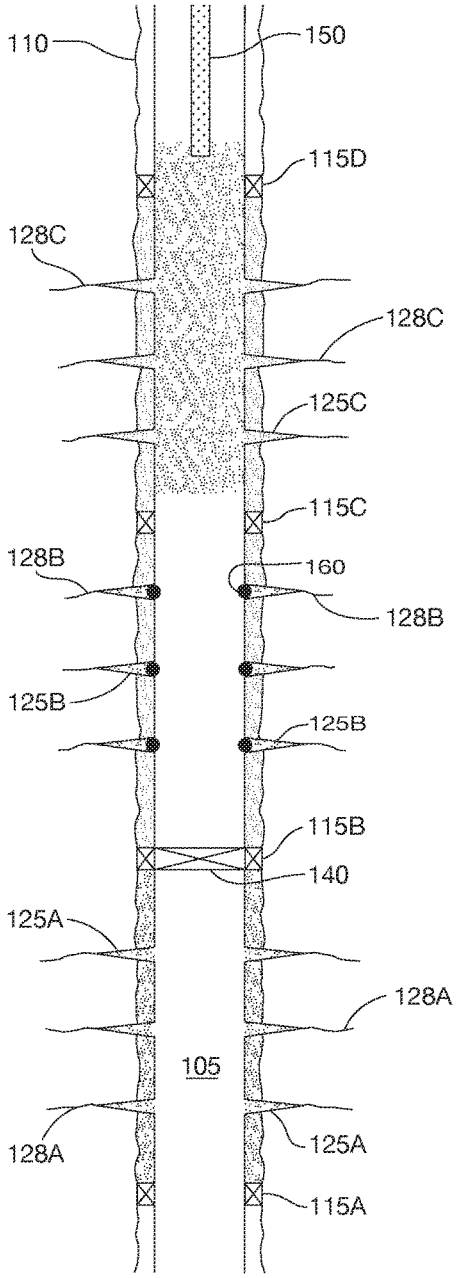

Finally, FIG. 1F shows the fracturing fluid 145 being pumped further into the wellbore 100. Specifically, the fracturing fluid 145 is pumped through the new perforations 125C along Zone C. Artificial fractures 128C have been induced in the subsurface formation 120 along Zone C.

Of interest, a new perforating gun 150 is visible in FIG. 1F. The new perforating gun 150 has been lowered into position along a next zone above Zone C.

The multi-zone completion procedure of FIGS. 1A through 1F is known as the "Just-In-Time" perforating process. The Just-In-Time perforating process represents a highly efficient method in that a fracturing fluid may be run into the wellbore with a perforating gun in the hole. As soon as the perfs are shot and fractures are formed, ball sealers are dropped. When the ball sealers seat on the perforations, a gun is shot at the next zone. These steps are repeated until all guns are spent. A new plug 140 is set and the process begins again.

The Just-In-Time perforating process requires low flush volumes and offers the ability to manage screen-outs along the zones. However, it does require that multiple plugs be drilled out in an extended well.

An alternate completion procedure that has been used is the traditional "Plug and Perf" technique. This is illustrated in FIGS. 2A through 2F. The FIG. 2 drawings present a series of side views of a lower portion of a wellbore 200. The wellbore 200 is undergoing a completion procedure that uses perforating plugs 240 and guns 250 in stages.

Figure 2A:
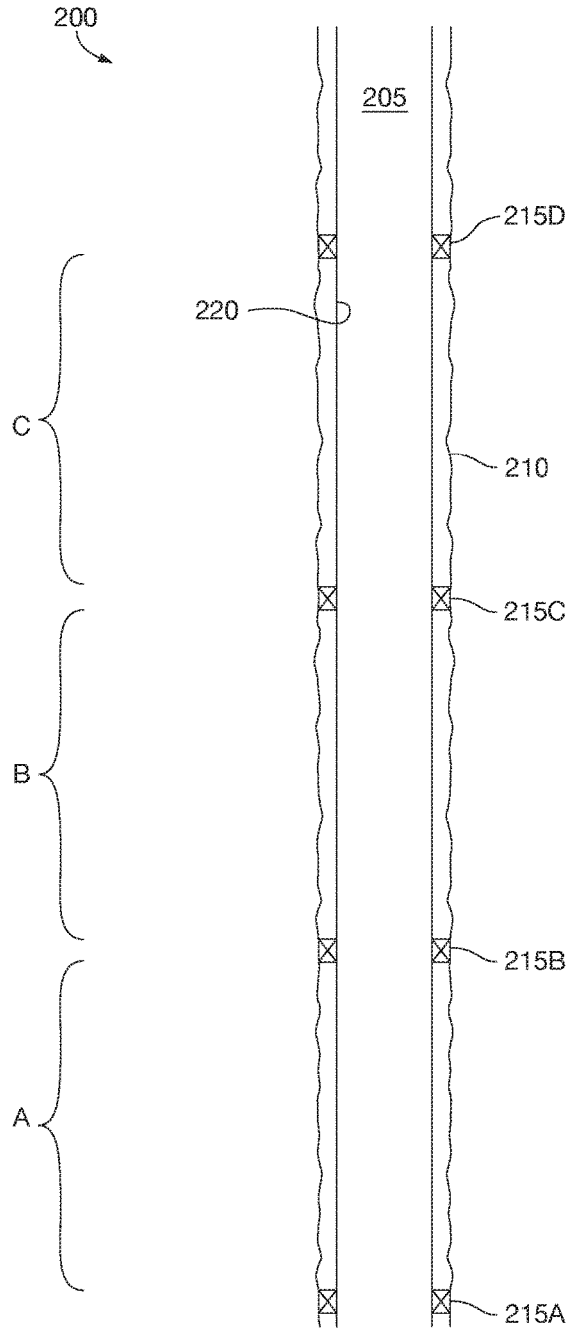
FIGS. 2A through 2F present a series of side views of a lower portion of a wellbore. The wellbore is undergoing a completion procedure that uses perforating guns and plugs in stages. This is a known procedure.

FIG. 2A presents a wellbore 200 that has been lined with a string of production casing 220. Annular packers 215A, 215B, 215C, 215D are placed along the wellbore 200 to isolate selected subsurface zones. The zones are identified as "A," "B" and "C."

First, FIG. 2A introduces the wellbore 200. The wellbore 200 is identical to the wellbore 100 of FIG. 1A. The wellbore 200 is lined with a string of production casing 220. The production casing 220 provides a bore 205 for the transport of fluids into the wellbore 200 and out of the wellbore 200.

The production casing 220 resides within a surrounding subsurface formation 210. Annular packers are again placed along the casing 220 to isolate selected subsurface zones, identified as "A," "B" and "C." The packers, in turn, are designated as 215A, 215B, 215C and 215D.

Figure 2B:
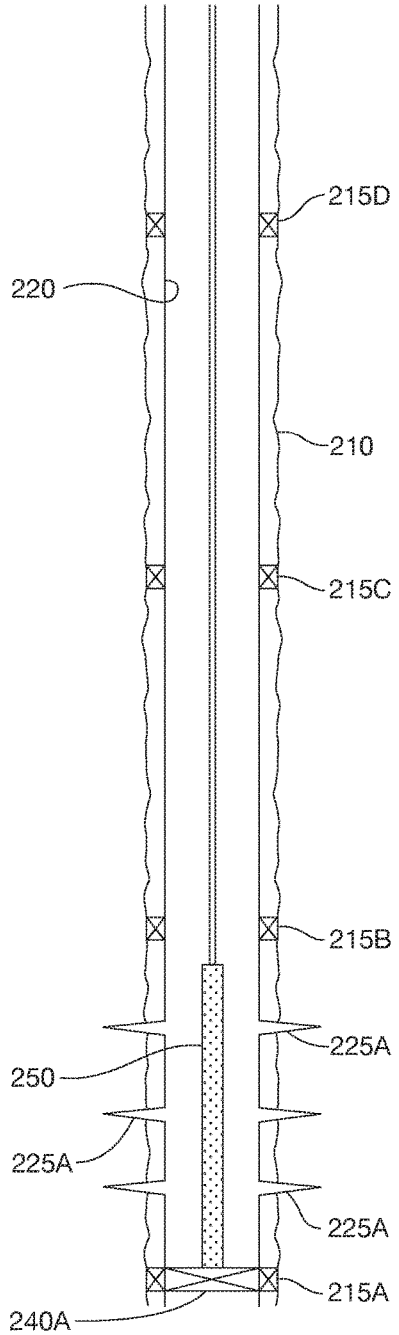

In order to complete the wellbore 200, Zones A, B and C are each perforated. In FIG. 2B, a perforating gun 250 has been run into the bore 205. The gun 250 has been placed along Zone A. Perforations 225A have been formed in the production casing 120 by detonating charges associated with the perforating gun 250.

Along with the perforating gun 250, a plug 240A has been set. In practice, the plug 240A is typically run into the bore 205 at the lower end of the perforating gun on the wireline 255. In other words, the plug 240A and the gun 250 are run into the wellbore 200 together before the charges are detonated.

Next, a fracturing fluid 245 is injected into the newly-formed perforations 225A. The fracturing fluid 245, with proppant, is injected under pressure in order to flow through the perforations 225A and into the formation 210. In this way, artificial fractures 228A are formed.

Figure 2C:
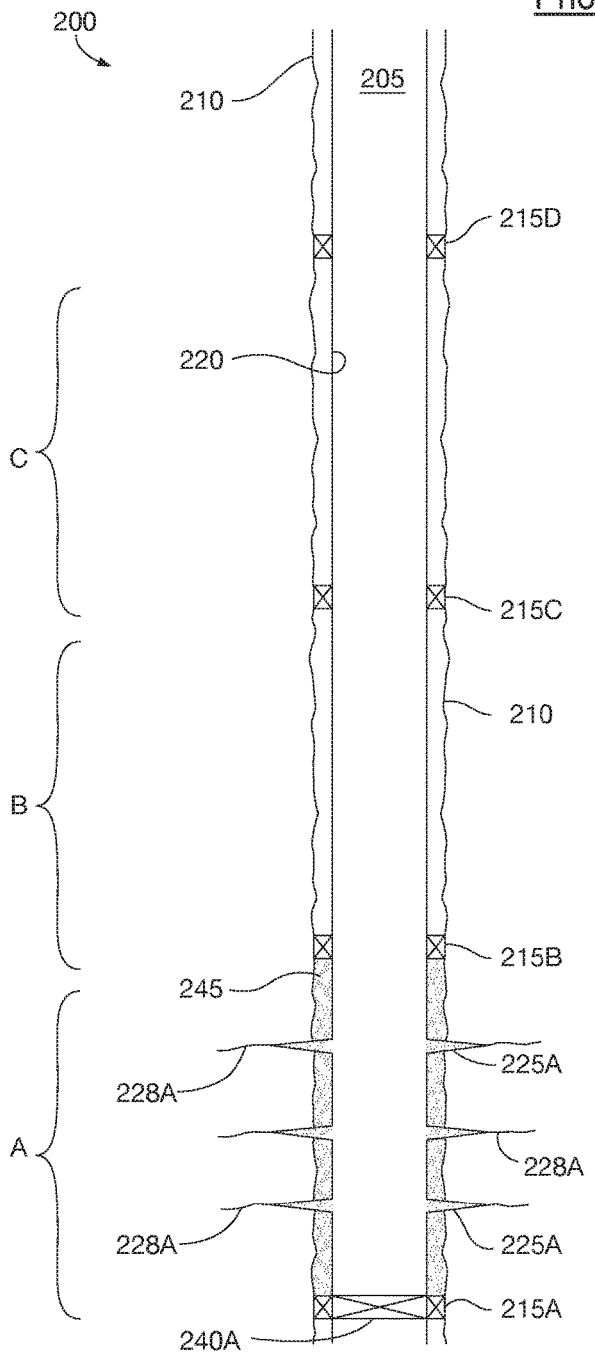

FIG. 2C shows that fractures 228A have been formed in the subsurface formation 210 along Zone A. Proppant is now seen residing in an annular region along Zone A. Thus, something of a gravel pack is formed.

In the completion method of the FIG. 2 drawings, the process of perforating and fracturing along Zone A is repeated in connection with Zones B and C. FIG. 2D shows that a second perforating gun 250 and a second plug 240B having been run into the wellbore 200. The gun 250 is placed along Zone B while the plug 240B is set adjacent packer 215B. Further, charges associated with the perforating gun 250 have been detonated, forming new perforations 225B along Zone B.

Figure 2D:
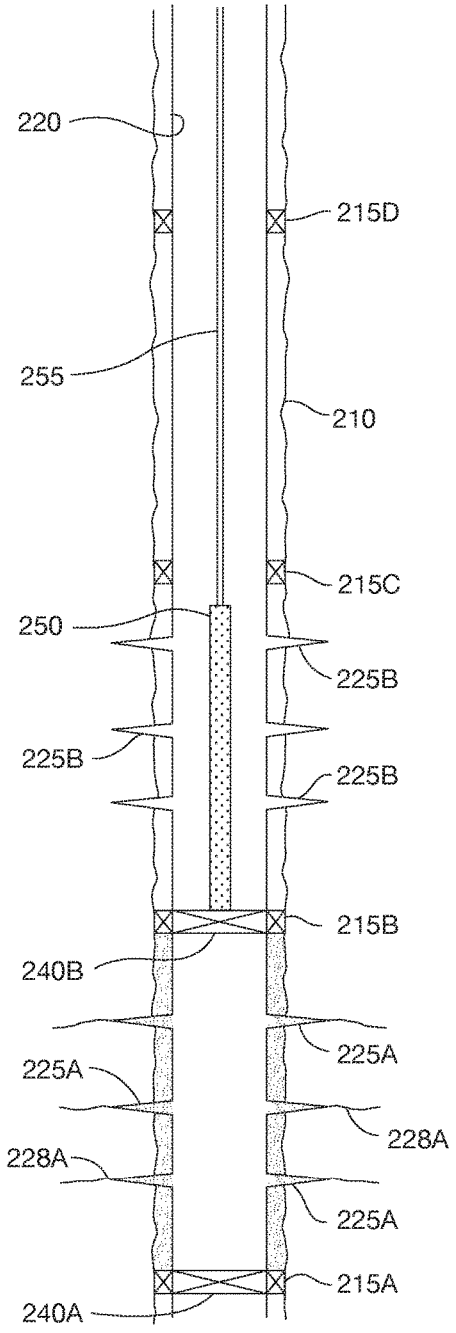
Figure 2E:
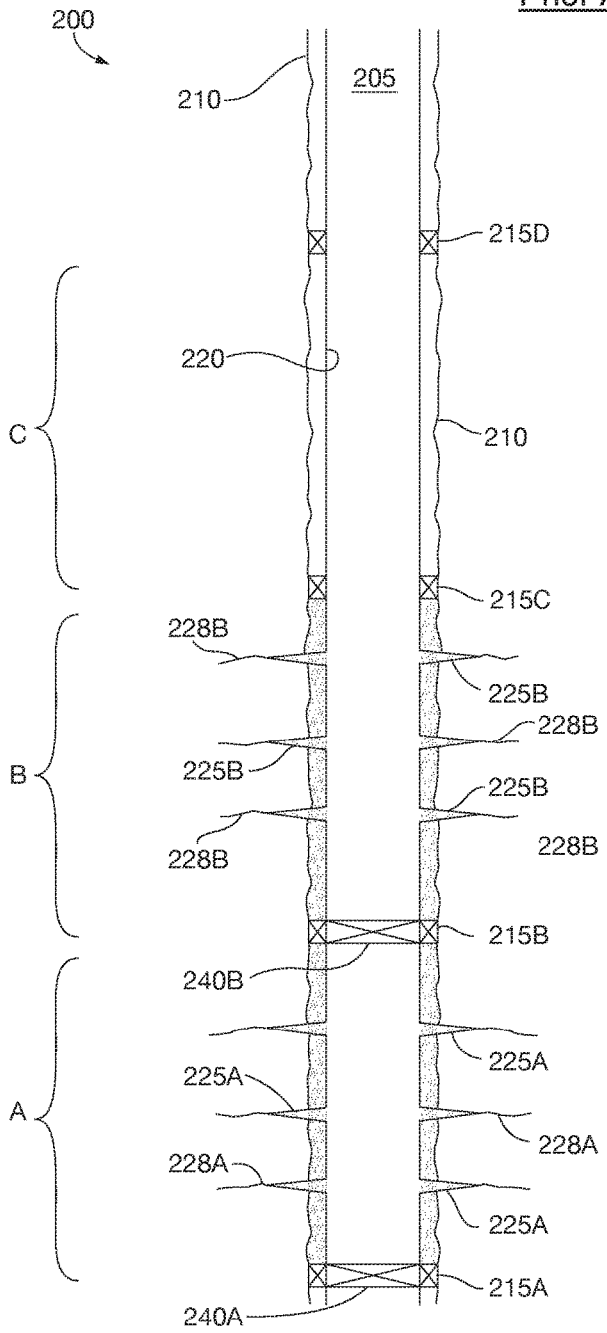

Next, a fracturing fluid 245 is injected into the newly-formed perforations 225B. The fracturing fluid 245, with proppant, is injected under pressure in order to flow through the perforations 225B and into the formation 210. In this way, and as shown in FIG. 2E, new artificial fractures 228A are formed.

Figure 2F:
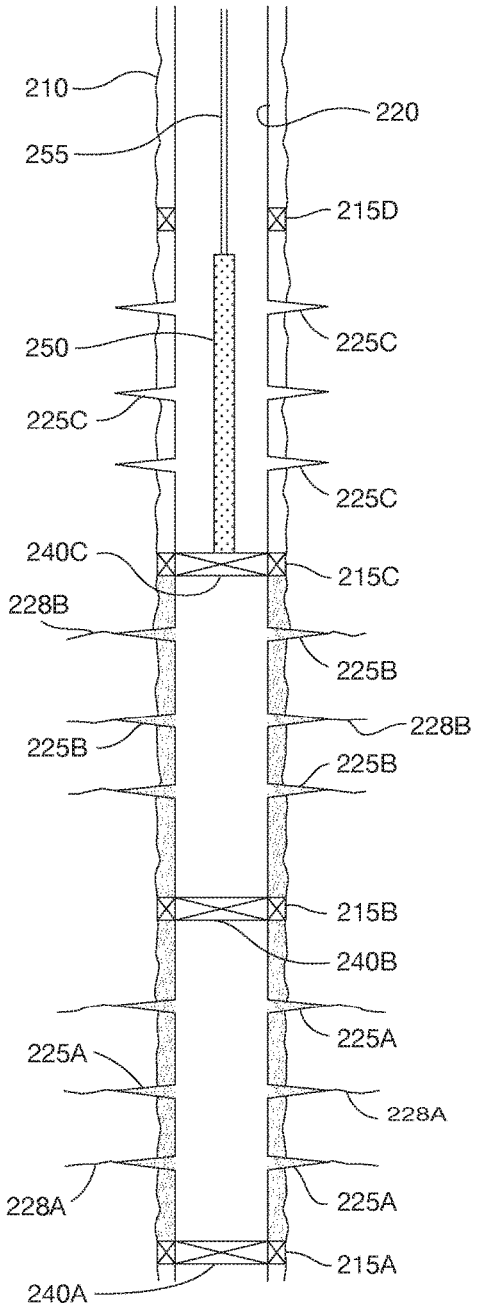

The "Plug and Perf" process is repeated for Zone C. FIG. 2F shows that a third perforating gun 250 has been lowered into the bore 205 adjacent Zone C, and a third plug 240C have been set adjacent a packer intermediate Zones B and C. Further, the perforating gun 250 is shown forming perforations along Zone C. It is understood that fractures (not shown) are then created in the subsurface formation 210 along Zone C using a fracturing fluid (also not shown).

In order to perforate multiple zones, the "Plug and Perf" process requires the use of many separate plugs. Those plugs, in turn, must be drilled out before production operations may commence. Further, the "Plug and Perf" process requires large flush volumes and high cost related to screen-out. At the same time, the process is popular because it enjoys a low hardware risk.

Yet another completion procedure that has been used involves the placement of multiple fracturing sleeves (or "frac sleeves") along the production casing. This is known as "Ball and Sleeve" completion. The Ball and Sleeve technique is illustrated in FIGS. 3A through 3F. The FIG. 3 drawings present a series of side views of a lower portion of a wellbore 300. The wellbore 300 is undergoing a completion procedure that uses frac sleeves 321 in stages.

Figure 3A:
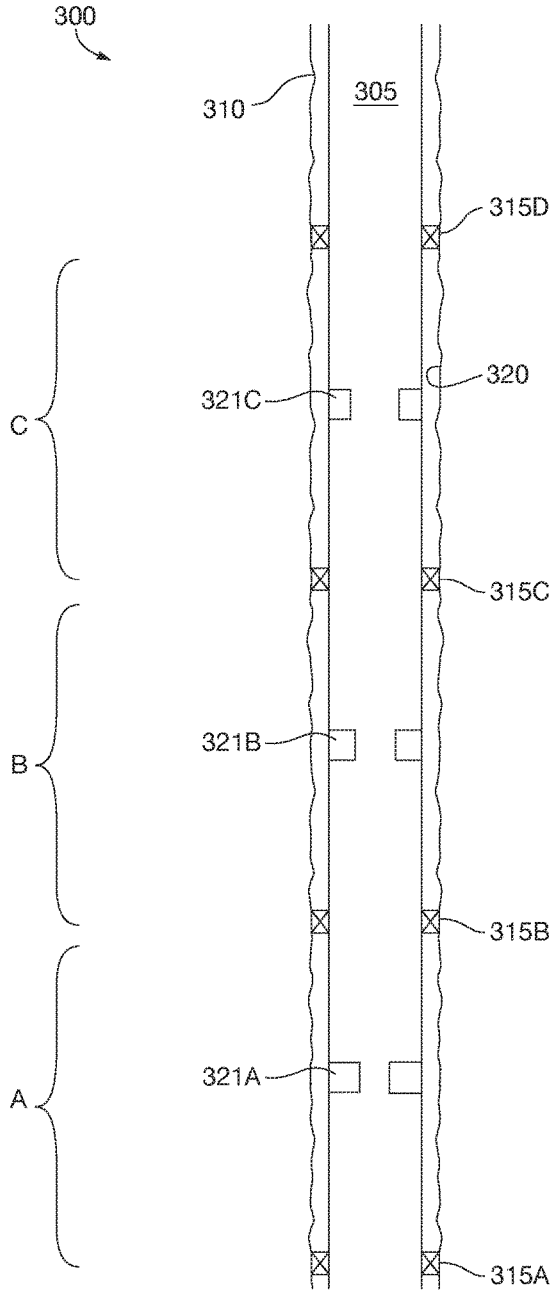
FIGS. 3A through 3F present a series of side views of a lower portion of a wellbore. The wellbore is undergoing a completion procedure that uses perforating guns, fracturing sleeves and dropped balls, in stages. This is a known procedure.

First, FIG. 3A introduces the wellbore 300. The wellbore 300 is identical to the wellbore 100 of FIG. 1A. The wellbore 300 is lined with a string of production casing 320 that provides a bore 305 for the transport of fluids into and out of the wellbore 300. Annular packers 315A, 315B, 315C, 315D are placed along the casing 320 to isolate selected subsurface zones. The zones are identified as "A," "B" and "C."

In the completion processes shown in the FIG. 1 and the FIG. 2 series, each of Zones A, B and C is sequentially perforated. However, in the completion process of the FIG. 3 series, frac sleeves 321A, 321B, 321C are used. The frac sleeves 321A, 321B, 321C are sequentially opened using balls 323A, 323B, 323C.

Figure 3B:
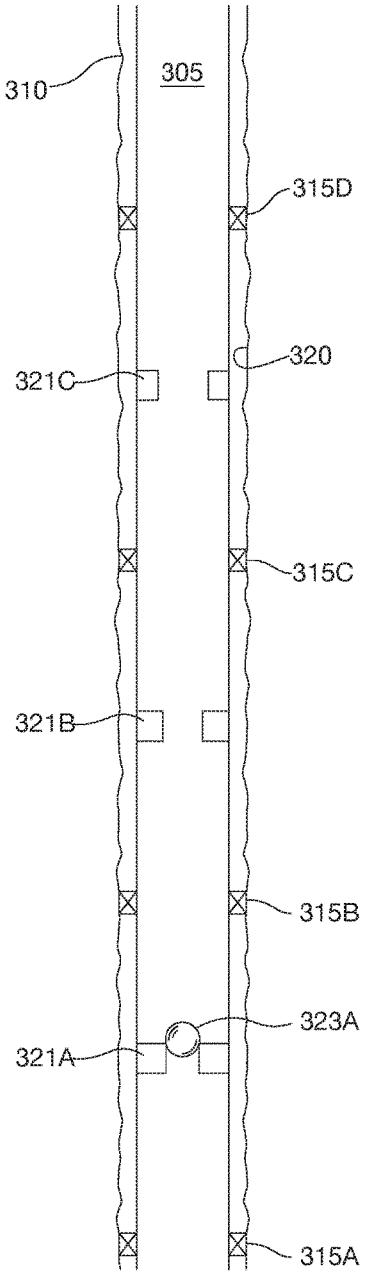

Looking now at FIG. 3B, it can be seen that frac sleeve 321A has been placed along Zone A. A ball 323A has been dropped into the wellbore 300 and landed onto the frac sleeve 321A.

Figure 3C:
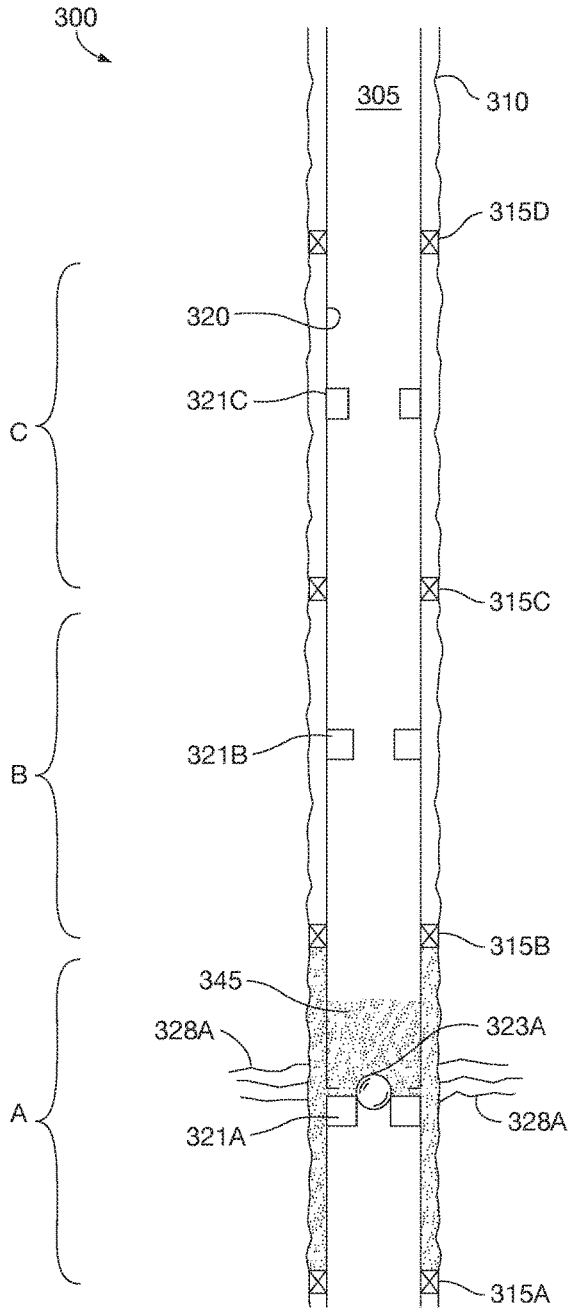
Figure 3D:
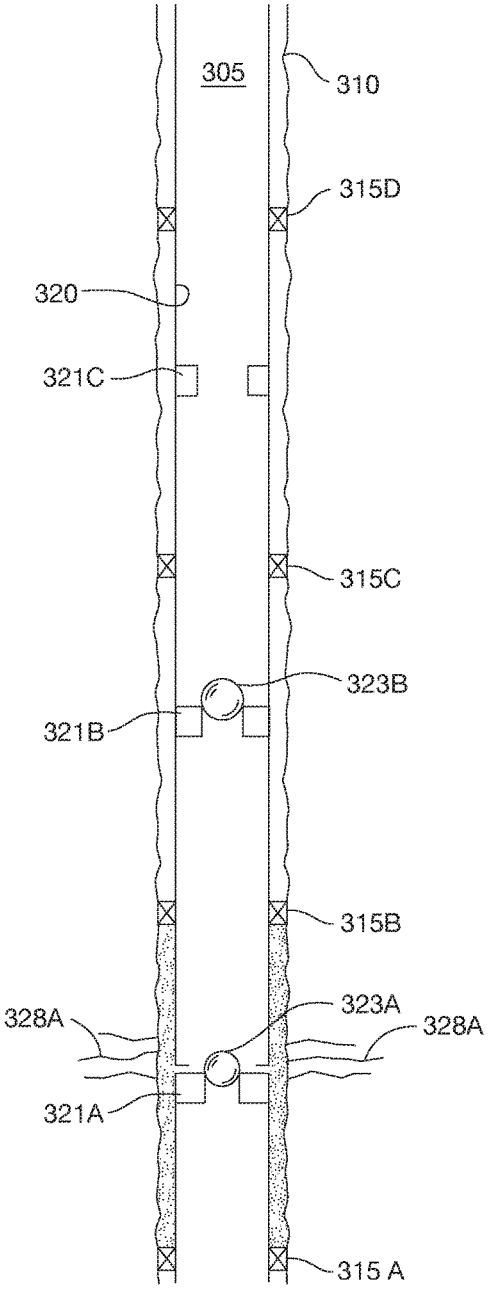

FIG. 3C shows that hydraulic pressure has been applied to open the fracturing sleeve 321A. This is done by pumping a fracturing fluid 345 into the bore 305. As shown in FIG. 3C, the fracturing fluid 345 flows through the frac sleeve 321A, into the annular region between the production casing 320 and the surrounding subsurface formation 310, and into the formation 310 itself. Fractures are being induced in the subsurface formation 310 along Zone A. Additionally, proppant is seen now residing in the annular region along Zone A.

In the completion method of the FIG. 3 drawings, the process of opening a sleeve and fracturing along Zone A is repeated in connection with Zones B and C. FIG. 2D shows that a second ball 323B has been dropped into the wellbore 300 and landed on a sleeve 321B. The sleeve 321B resides along Zone B.

Figure 3E:
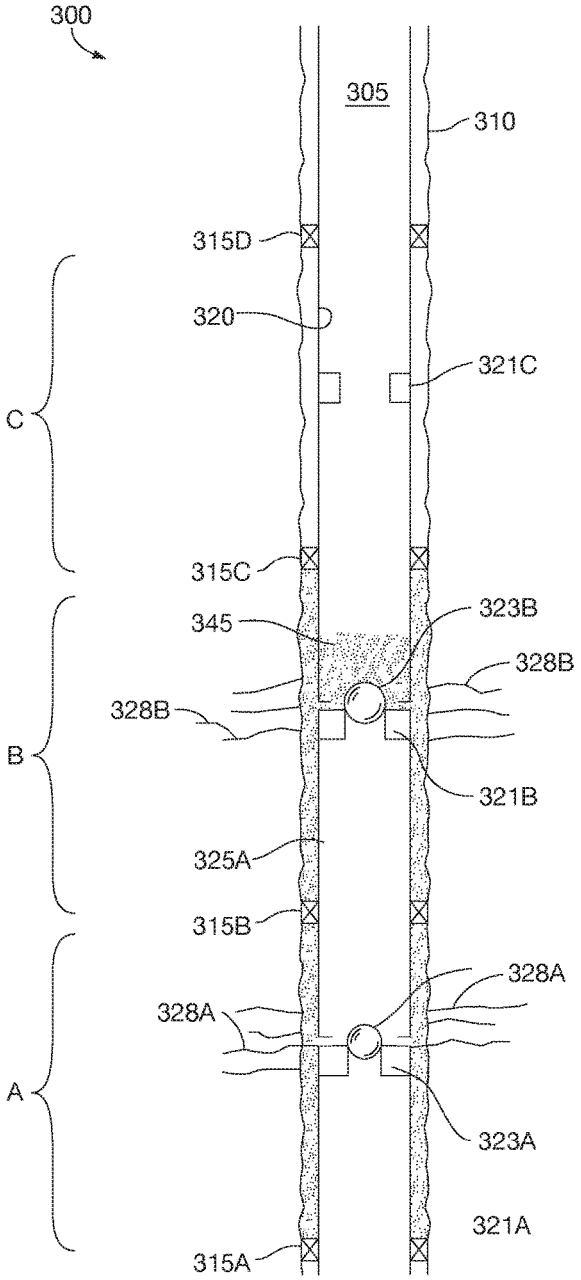

FIG. 3E shows that hydraulic pressure has been applied to open the fracturing sleeve 321B. This is done by pumping a fracturing fluid 345 into the wellbore 300. Fractures are being induced in the subsurface formation 310 along Zone B. Proppant is seen residing now in an annular region along Zone B.

Figure 3F:
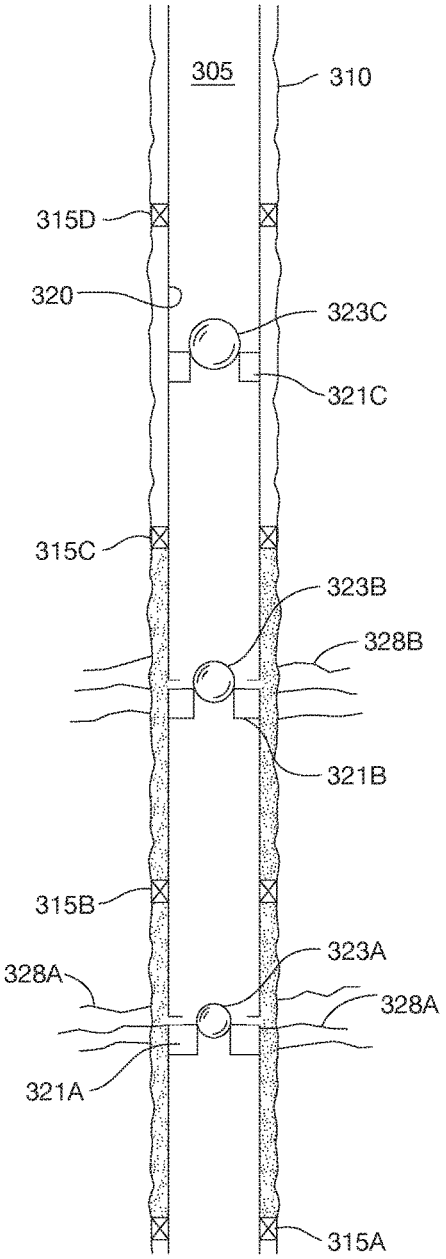

The "Ball and Sleeve" process is repeated for Zone C. FIG. 3F shows that a third ball 323C has been dropped into the bore 305. The ball 323C has landed onto the frac sleeve 321C adjacent Zone C. It is understood that fractures (not shown) are then created in the subsurface formation 310 along Zone C.

The use of the sleeves 321A, 321B, 321C as shown in the Figure series reduces the flush volumes needed for completion. This, in turn, reduces the environmental impact. At the same time, in order to fracture multiple zones, the "Ball and Sleeve" process requires the use of many separate sleeves. Those of ordinary skill in the art will understand that each successive sleeve moving down the wellbore has a smaller inner diameter for the ball seat. This requires later drill-out of at least some of the sleeves for completion. Further, the use of multiple sleeves creates a higher hardware risk and a higher risk of screen-out.

It is observed that in some extended wells being completed today, as many as 15 frac sleeves may be employed. As longer completions are designed, up to 30 frac sleeves may be considered. Moving from 15 to 30 frac sleeves more than doubles the risk of failure due to mechanical failure of a ball seat, premature failure of shear pins holding a sleeve, or failure of a ball itself.

Completions that involve multiple plugs also carry a risk. Each plug must be carefully located adjacent a packer. As well length grows, more plugs are used. The Plug and Perf technique (shown in the FIG. 2 series) requires repeated wireline runs for each stage, with each stage representing about 300 feet of net pay. This requires that up to 29 frac plugs be installed for 30 stage treatments for a 10,000 foot horizontal section. Drill out of all of the plugs is cost prohibitive, and in some cases 10 or more plugs may be left in the well.

As the need for "pinpoint stimulation" has gained recognition, the number of stages may increase in the future for a given well length. However, experience with single zone stimulation has shown that as the wellbore is divided into smaller treated segments, the risk of "screen out" increases. This means that the chance of pumping into easily treatable rock decreases. Recovery from screen-out upset for a frac-sleeve-only completion is very costly and usually involves well intervention and removal (i.e., destruction) of the hardware placed in the well during drilling operations.

In addition to the compounding complication of extended-length multi-zone completions, drill out or clean out of the hardware is required after completion. This is because the ever-decreasing sleeve size to the end of the wellbore will not accommodate most logging tools or entry of a 2⅜" EUE upset tubing working string for cleanout or other activities. Thus, sleeves and seats and other devices must be milled/drilled out. In addition, much of the applied technology reduces the working ID of casing, limiting intervention with coiled or jointed tubing strings.

In addition to these issues, each of the above completion techniques requires multiple "stops" in the operation to "re-tool." Therefore, it is desirable to modify the procedures presented in the processes of the FIG. 1 series, the FIG. 2 series and the FIG. 3 series to increase the efficiency of multi-zone fracture operations by making the operation more seamless. Further, it is desirable to modify the procedures presented in the processes of the FIG. 1 series, the FIG. 2 series and the FIG. 3 series to both reduce the hardware risk and reduce the time and expense incident to drill-out.

Two separate methods are presented in response. The first method uses perforating guns that are lowered into the wellbore. The guns are then raised using a wireline for the perforating of multiple zones sequentially. The second method employs a series of autonomous completion assemblies, with each assembly having a perforating gun. Separate assemblies are released into the wellbore sequentially for perforating separate zones. In each method, multiple zones are perforated and fractured without a stopping of wellbore operations.

The first method is demonstrated in FIGS. 4A through 4F. The FIG. 4 drawings present a series of side views of a lower portion of a wellbore 400. The wellbore 400 is undergoing a completion procedure that uses a series of perforating guns 450 and ball sealers 460 in a novel, seamless process.

Figure 4A:
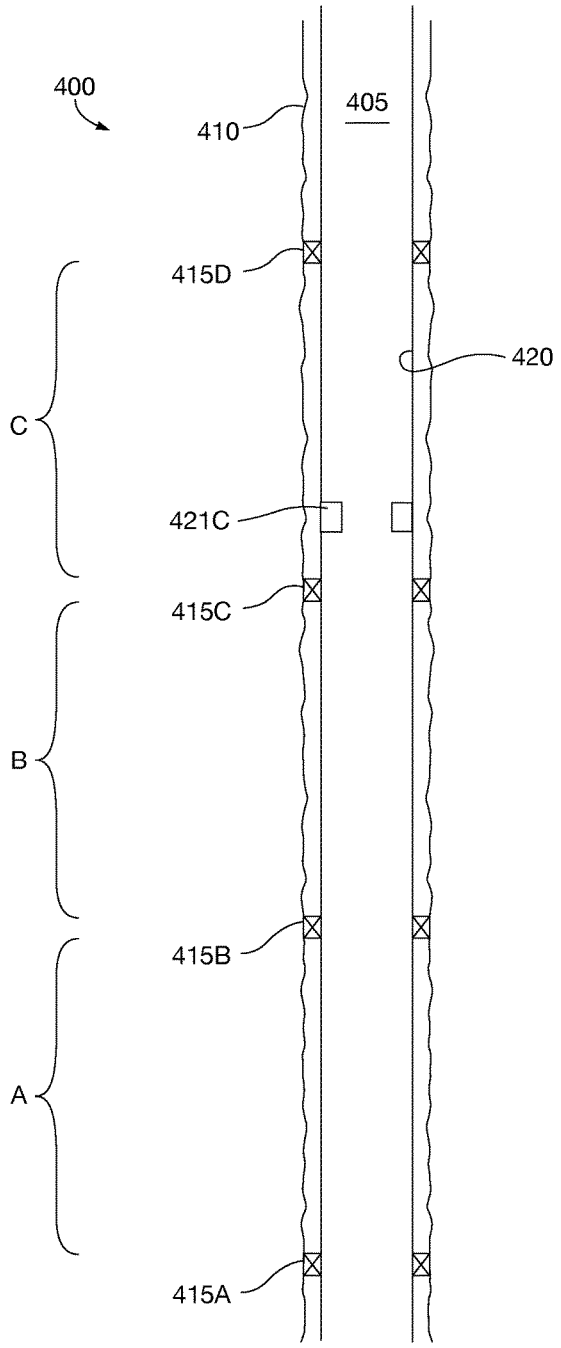
FIGS. 4A through 4F present a series of side views of a lower portion of a wellbore. The wellbore is undergoing a completion procedure that uses perforating guns and ball sealers in a novel, seamless procedure.

First, FIG. 4A introduces the wellbore 400. The wellbore 400 is identical to the wellbore 100 of FIG. 1A. The wellbore 400 is lined with a string of production casing 420. The production casing 420 provides a bore 405 for the transport of fluids into and out of the wellbore 400.

The production casing 420 resides within a surrounding subsurface formation 410. Annular packers 415A, 415B, 415C, 415D are again placed along the casing 220 to isolate selected subsurface zones, identified as "A," "B" and "C." The packers, in turn, are designated as 415A, 415B, 415C and 415D.

Figure 4B:
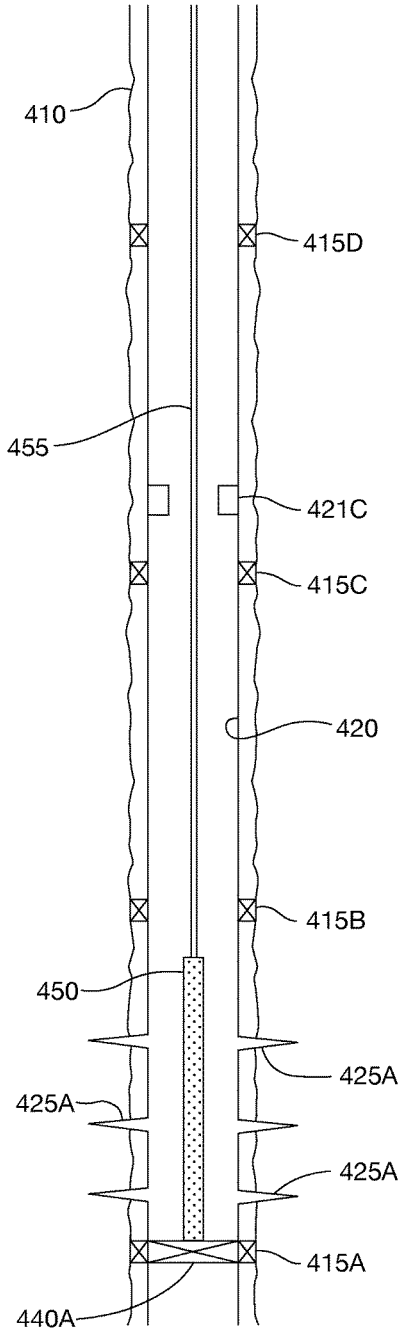

In order to complete the wellbore 400, Zones A, B and C are each perforated. In FIG. 4B, a perforating gun 450 has been run into the bore 405. The gun 450 has been placed along Zone A. Perforations 425A have been formed in the production casing 420 by detonating charges associated with the perforating gun 450.

The perforating gun 450 may be a select fire gun that fires, for example, 16 shots. The gun 450 has associated charges that detonate in order to cause shots to be fired from the gun 450 into the surrounding production casing 420. Typically, the perforating gun 420 contains a string of shaped charges distributed along the length of the gun 420 and oriented according to desired specifications. However, in the gun 450, the charges are not connected to a single detonating cord to ensure simultaneous detonation of all charges; instead, a series of cords, such as four cords, is provided to allow sequential signals. Examples of suitable perforating guns include the Frac Gun™ from Schlumberger, and the GForce® from Halliburton.

Along with the perforating gun 450, a plug 440A has been set. In practice, the plug 440A is typically run into the bore 405 at the lower end of the perforating gun 450 on a wireline 455. In other words, the plug 440A and the gun 450 are run into the wellbore 400 together before the charges are detonated.

Next, a fracturing fluid 445 is injected into the newly-formed perforations 425A. The fracturing fluid 445, with proppant, is injected under pressure in order to flow through the perforations 425A and into the formation 410. In this way, artificial fractures 428A are formed.

Figure 4C:
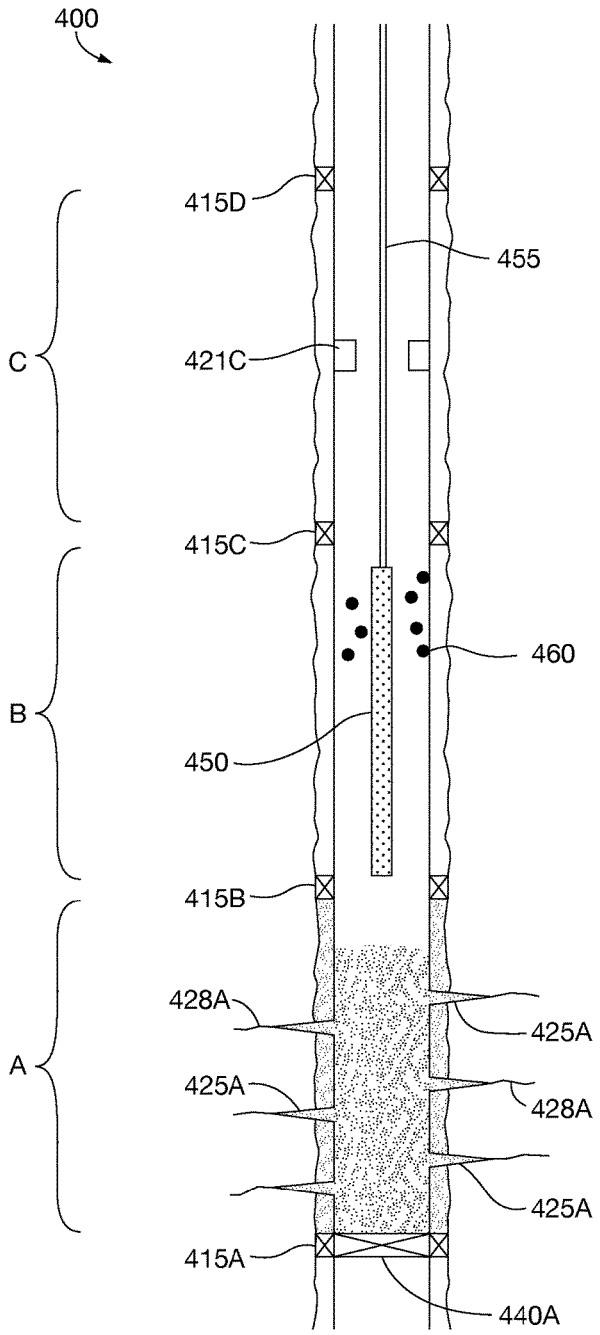
Figure 4D:
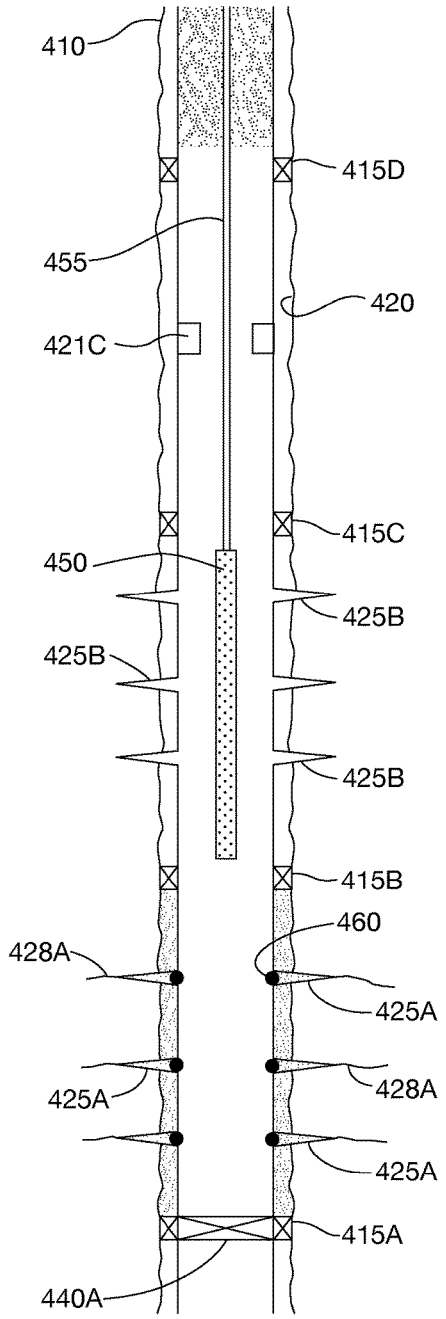

FIG. 4C shows that fractures 428A have been formed in the subsurface formation 410 along Zone A. Proppant is now seen residing in an annular region along Zone A. Thus, something of a gravel pack is formed as fracturing fluid 445 is injected.

Of interest, the multi-zone fracturing of the FIG. 4 series of drawings is seamless. This means that preparations for fracturing a next zone are already under way while a present zone is being fractured. In the view of FIG. 4C, the perforating gun 450 has been raised up to Zone B. Additionally, ball sealers 460 have been dropped into the bore 405.

In the completion method of the FIG. 4 drawings, the process of perforating and fracturing along Zone A is repeated in connection with Zones B and C. FIG. 4D shows that charges associated with the perforating gun 450 have been detonated, forming perforations 425B along Zone B. At the same time, the ball sealers 460 have plugged the perforations 425A along Zone A. For this reason, there is beneficially no need for setting a new plug adjacent packer 415B.

Figure 4E:
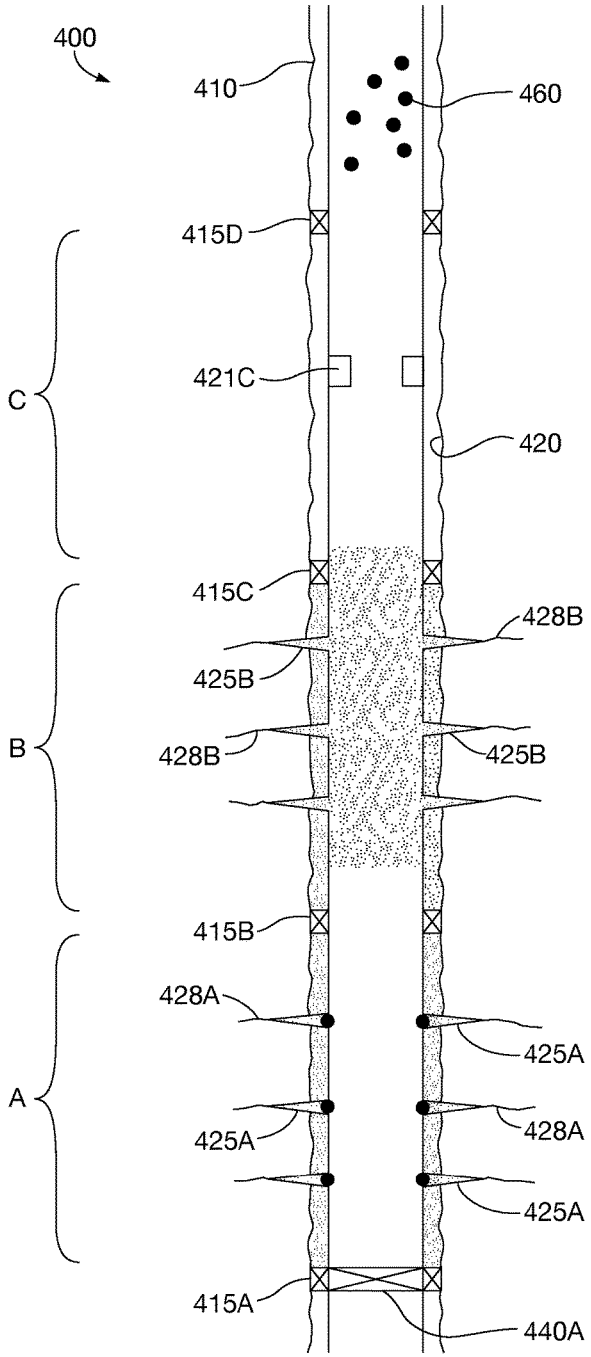

Next, fracturing fluid 445 is injected into the newly-formed perforations 425B. The fracturing fluid 445, with proppant, is injected under pressure in order to flow through the perforations 425B and into the formation 410. In this way, and as shown in FIG. 4E, new artificial fractures 428A are formed. At the same time, a new set of ball sealers 460 has been released into the bore 405.

It is noted that at some point the charges in the perforating gun 450 will be spent. In one embodiment of the method of the FIG. 4 series, charges are shot until the gun 450 reaches a frac sleeve along the casing 420. In FIG. 4E, an illustrative frac sleeve 421C is shown along Zone C. The frac sleeve 421C is in its closed position.

Figure 4F:
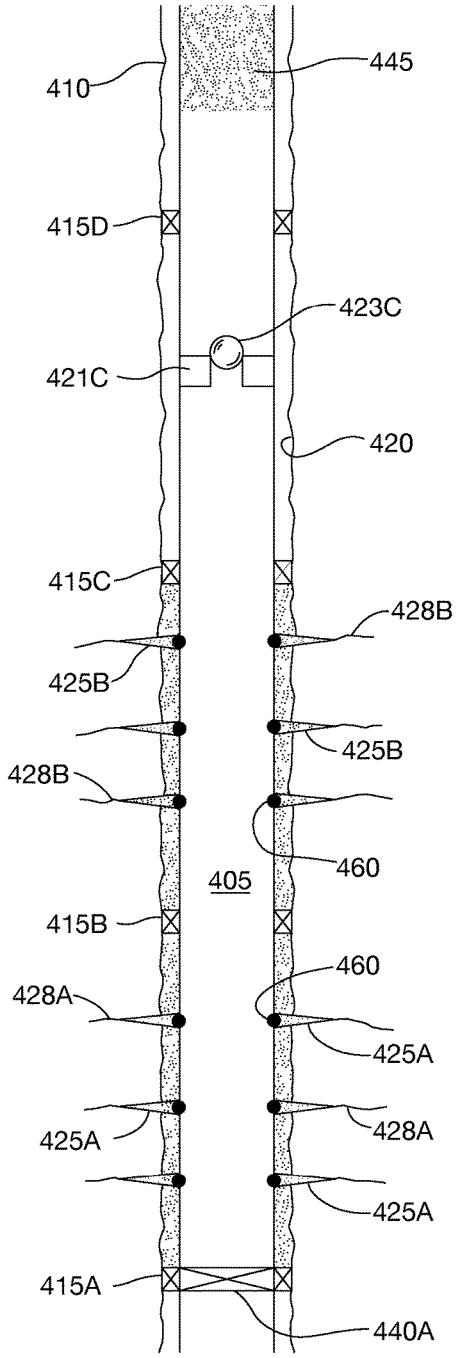

FIG. 4F shows that ball sealers 460 have been placed in the perforations 425B along Zone B. In addition, a ball 423C has been dropped into the bore 405 and landed on the frac sleeve 421C. Further, fracturing fluid 445 is being pumped through the perforations along Zone B. The fracturing fluid 445 is pumped into the wellbore 400 behind the ball 423C, which in turn is dropped behind the ball sealers 460. In this way, no stoppage of operations occurs.

It is observed that in a horizontal well, the last sleeve would need to stay open to allow for pump down of the ball 423C. This is because the well would have no injectivity as all perforations would be covered with ball sealers 460. It is also noted that in order to drop or pump the ball 423C down the wellbore 400, the wireline 455 and perforating gun 450 must be removed from the bore 405.

Figure 4G:
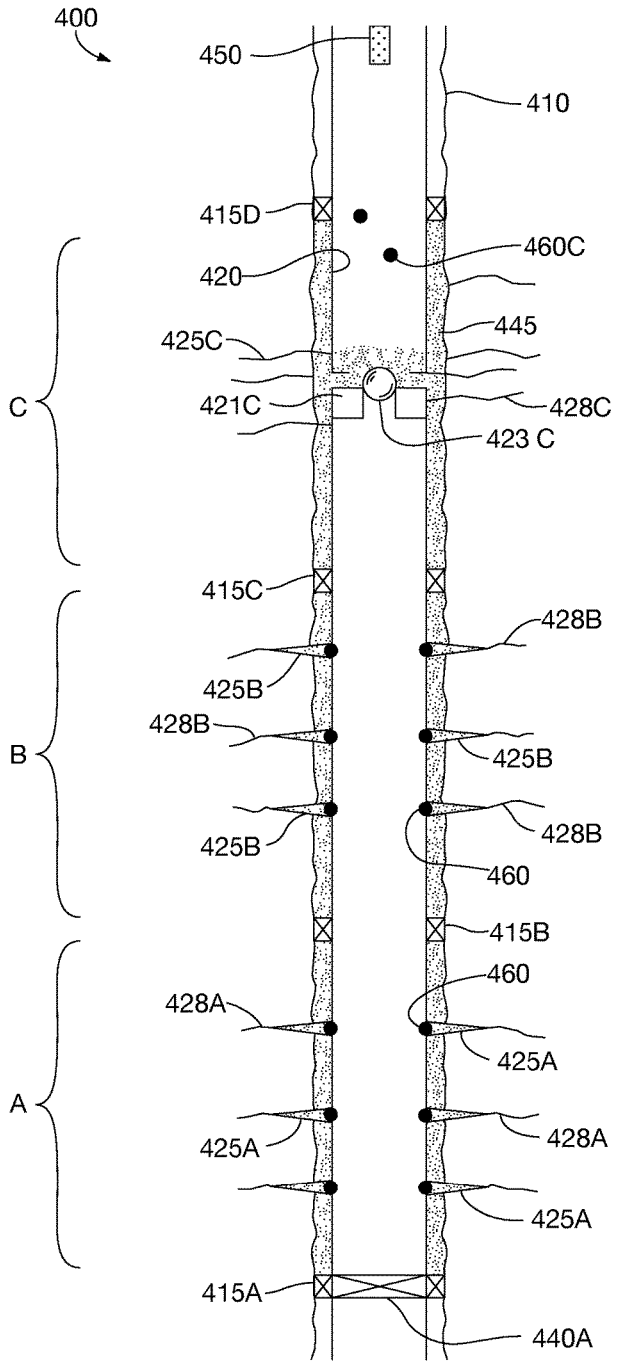
FIG. 4G shows the fracturing sleeve having been opened. Fracturing fluid is now being pumped through the sleeve to induce artificial fractures along Zone C. Simultaneously, ball sealers have been dropped into the wellbore behind the fracturing fluid.

As a next step in the operation, the frac sleeve 421C is opened. FIG. 4G shows the fracturing sleeve 421C having been opened. This is done by pumping a fracturing fluid 445 into the wellbore 400 under pressure. As the sleeve 421C opens, fracturing fluid 445 flows through the sleeve 421C, into the annular region between the production casing 420 and the surrounding subsurface formation 410, and into the formation 410 itself. Fractures 428C are being induced in the subsurface formation 410 along Zone C. Additionally, proppant is seen now residing in the annular region along Zone C.

In accordance with the seamless nature of the operation, ball sealers 460C have been dropped in the wellbore 400 behind the fracturing fluid 445. These ball sealers 460C are dimensioned to plug the frac sleeve 421C after fractures 428C have been formed along Zone C.

Figure 4H:
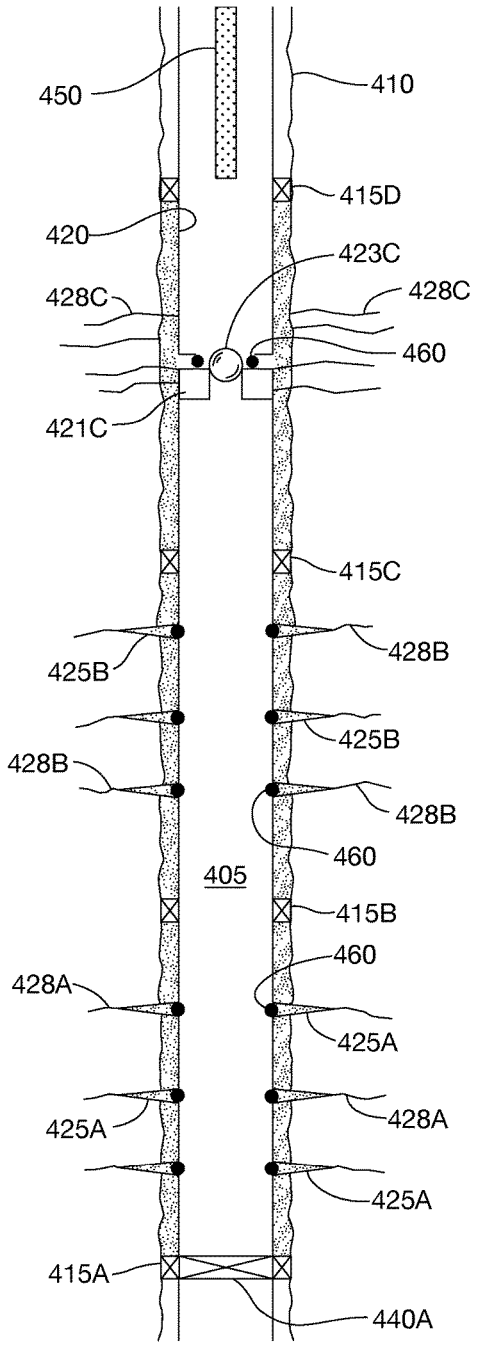
FIG. 4H shows the ball sealers of FIG. 4G having landed on the fracturing sleeve to provide a seal. Additionally, a new fracturing gun is being lowered into the wellbore to form fractures along a zone above Zone C.

Moving to the next drawing, FIG. 4H shows the ball sealers 460C of FIG. 4G having landed on the fracturing sleeve 421C. This seals the fracturing sleeve 421C from future fluid injections. Additionally, a new fracturing gun 450 is being lowered into the wellbore 400 on a wireline (not shown) to form fractures along a zone above Zone C. Thus, multiple additional zones may be perforated and fractured using the same gun 450 until those charges are spent and a next frac sleeve is encountered.

Figure 5:
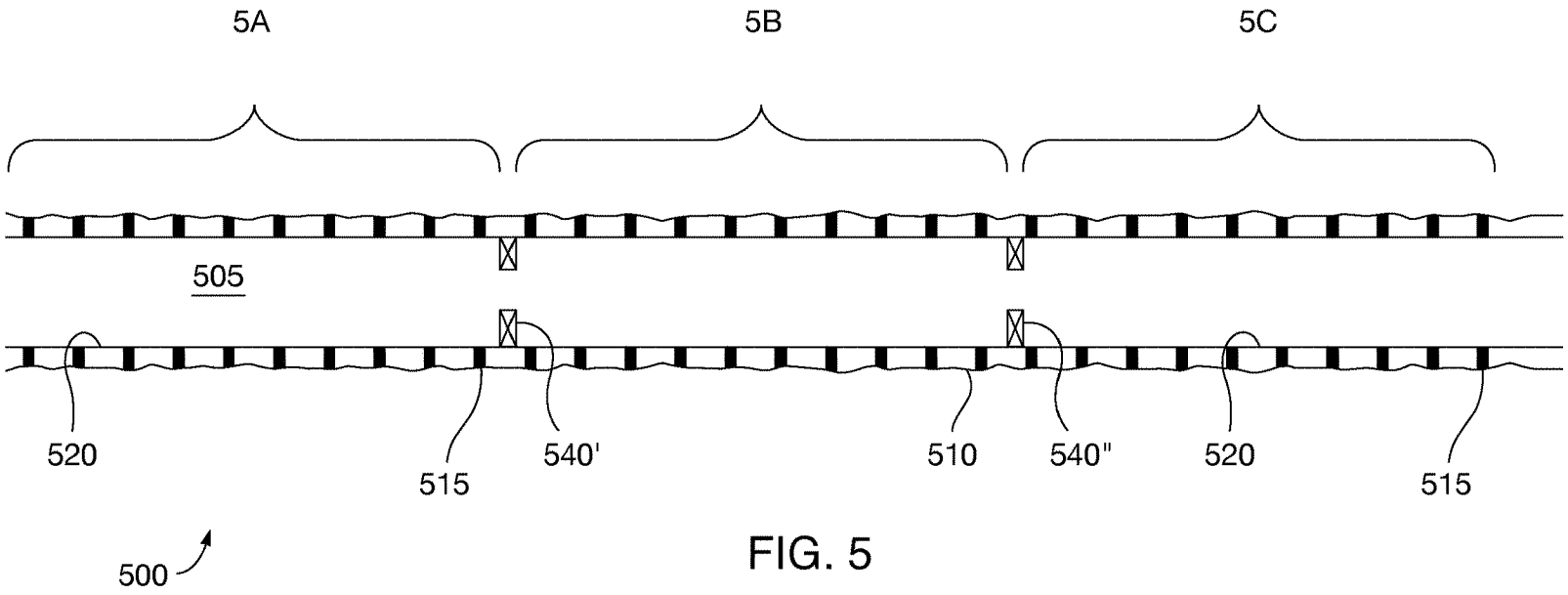
FIG. 5 is a schematic view of a portion of a horizontal wellbore. Zones A, B and C are shown along the wellbore, with each zone having ten sub-zones separated by annular packers. The zones, or sets of sub-zones, are separated by fracture sleeves.

The multi-zone fracturing process of the FIG. 4 series allows multiple zones along a wellbore to be perforated while using only a few frac sleeves. FIG. 5 is a schematic view of a portion of a wellbore 500. Here, Zones 5A, 5B and 5C are shown along the wellbore 500. Each of Zones 5A, 5B and 5C is separated by a frac sleeve. In the illustrative arrangement of FIG. 5, the wellbore 500 is completed horizontally, with frac sleeves 540' and 540" being shown.

Each of Zones 5A, 5B and 5C illustratively contains about ten sub-zones. Each sub-zone, in turn, is separated by a packer 515. The sub-zones in FIG. 5 are analogous to Zones A, B or C in FIG. 4A. Likewise, packers 515 are analogous to packers 415A, 415B or 415C of FIG. 4A, and frac sleeves 540' and 540" are analogous to frac sleeve 421C of FIG. 4A.

In the arrangement of FIG. 5, it is proposed that a single perforating gun 450 would shoot ten sub-zones. The perforating gun 450 would then be pulled from the wellbore 500, and a ball would be landed on a frac sleeve 540'. This would allow the operator to perforate, plug and fracture multiple sub-zones without stopping operations.

It is understood that the number of sub-zones is preferably correlated to the number of zones that can be sequentially shot using a single perforating gun. It is also understood that the operator will have to stop the perforating/sealing/fracturing process momentarily when it is time to change guns and drop the sealing ball on a next frac sleeve, such as sleeve 540'. The frac sleeves 540", 540' are spaced along the wellbore 500 based on the number of independent perforating guns on the wireline perforating tool.

The second method mentioned above for fracturing multiple zones along an extended-length wellbore employs a series of autonomous completion assemblies, with each assembly having a perforating gun. Separate assemblies are released into the wellbore sequentially for perforating separate zones.

FIGS. 6A through 6F present a series of side views of a lower portion of a wellbore 600. The wellbore 600 is undergoing a completion procedure that uses autonomous completion assemblies 700 in a novel seamless procedure. Of interest, the completion assemblies 700 each include a perforating gun portion 750 and a canister 720 portion (seen best in FIG. 6D). The canister 720 holds a plurality of ball sealers 760. The ball sealers 760 are released from the canister 720 shortly before or simultaneously with charges being detonated by the perforating gun 750.

Figure 6A:
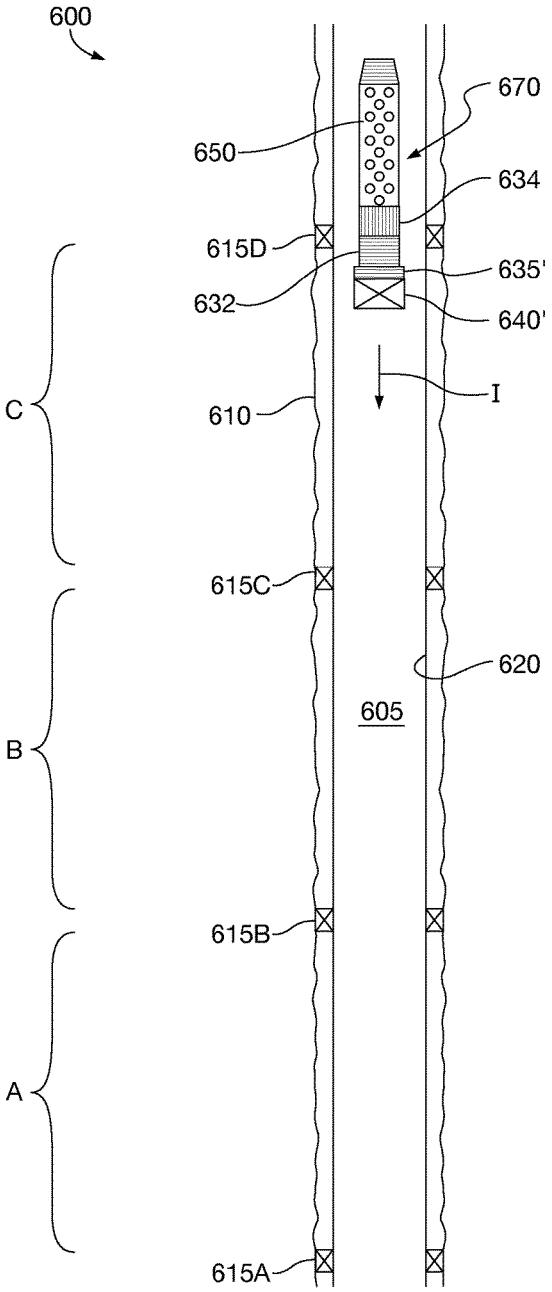
FIGS. 6A through 6F present a series of side views of a lower portion of a wellbore. The wellbore is undergoing a completion procedure that uses autonomous completion assemblies and ball sealers in a novel seamless procedure.

Referring first to FIG. 6A, FIG. 6A presents a portion of an extended-length wellbore 600. The wellbore 600 is identical to the wellbore 100 of FIG. 1A. The wellbore 600 is lined with a string of production casing 620. The production casing 620 provides a bore 605 for the transport of fluids into and out of the wellbore 600 during completion operations.

The production casing 620 resides within a surrounding subsurface formation 610. Annular packers are again placed along the casing 620 to isolate selected subsurface zones, identified as "A," "B" and "C." The packers are designated as 615A, 615B, 615C, and 615D.

Figure 6B:
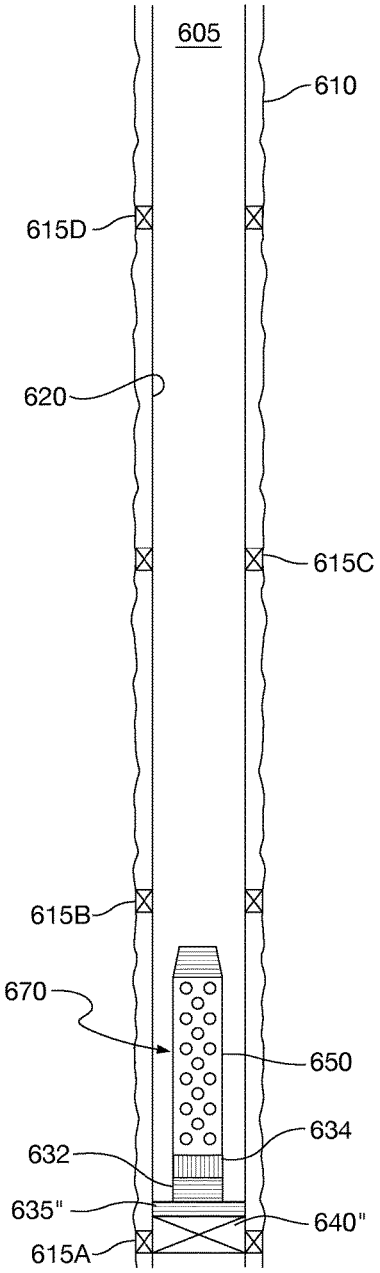

In order to complete the wellbore 600, Zones A, B and C are each perforated. In FIG. 6B, a perforating gun 650 has been released into the bore 605 for the purpose of perforating Zone A. In one aspect, the perforating gun 650 may be run into the wellbore using a wireline (not shown). In this arrangement, the wireline 455 and connected perforating gun 450 and plug 440A of FIG. 4B may be used. However, it is preferred, as shown in FIGS. 6A and 6B, that the perforating gun 650 be part of an autonomous assembly 670.

The autonomous perforating assembly 670 is designed to be released into the wellbore 600 and to be self-actuating. In this respect, the assembly does not require a wireline and need not otherwise be mechanically tethered or electronically connected to equipment external to the wellbore. The delivery method may include gravity, pumping, and tractor delivery.

The autonomous assembly 670 first includes a casing collar locator 632. The locator 632 measures magnetic flux as the assembly 670 falls through the wellbore 600. Anomalies in magnetic flux are interpreted as casing collars residing along the length of the casing string 620. The assembly 670 is aware of its location in the wellbore 600 by counting collars along the casing string 620 as the assembly 670 moves downward through the wellbore 600.

The assembly 670 also includes a plug body 640. The plug body 640 defines an elastomeric sealing element. The sealing element is mechanically expanded in response to a shift in a sleeve or other means as is known in the art for mechanically or hydraulically set tools. In one embodiment, the plug body plug body 640 is actuated by squeezing the sealing element using a sleeve or sliding ring; in another aspect, the plug body 640 is actuated by forcing the sealing element outwardly along wedges (not shown).

In the view of FIG. 6A, the plug body 640 is in its run-in position, indicated as 640'. However, when actuated the plug body 640 expands into a set position, indicated in FIG. 6B as 640".

The autonomous assembly 670 also includes an on-board controller 634. The on-board controller 634 is programmed to send at least two signals. A first signal is sent to the plug body 640 when the assembly 670 has reached a selected location along the wellbore 600. In the case of FIG. 6B, that location is a depth that is adjacent to the packer 615A, or that is otherwise somewhere along Zone A. A second signal is sent to the perforating gun 650 after the plug 640A has been set.

It is observed that the autonomous assembly 670 preferably includes a small set of slips 635. The slips 635 ride outwardly from the assembly 670 along wedges (not shown) spaced radially around the assembly 670. The slips 635 may be urged outwardly along the wedges in response to a shift in a sleeve or other means as is known in the art. The slips 670 extend radially to "bite" into the casing 620 when actuated. Examples of existing plugs with suitable slip designs are the Smith Copperhead Drillable Bridge Plug and the Halliburton Fas Drill® Frac Plug. In this manner, the assembly 670 is secured in position. In this instance, the first signal that is sent to the plug 640A is also used to actuate the slips 635.

Applicant has previously caused to be filed a patent application entitled "Autonomous Downhole Conveyance System." That application published at U.S. Patent Publ. No. 2013/0248174. That application provided details concerning the actuation of slips and an associated plug for an autonomous downhole assembly. That application is incorporated herein by reference in its entirety.

In FIG. 6A, the autonomous assembly 670 is shown in its run-in (or pre-actuated) position. In this position, the slips 635' and the plug 640' are in their run-in position. The assembly 670 in its pre-actuated position is falling in the wellbore 600 according to arrow "I."

FIG. 6B shows the autonomous assembly 670 having reached its destination. The on-board controller 634 has sent a signal causing the slips 635" and the associated plug 640" to move into their set (or actuated) position. The slips 635" and plug 640" are set along the production casing 620 at a location adjacent packer 615A.

Figure 6C:
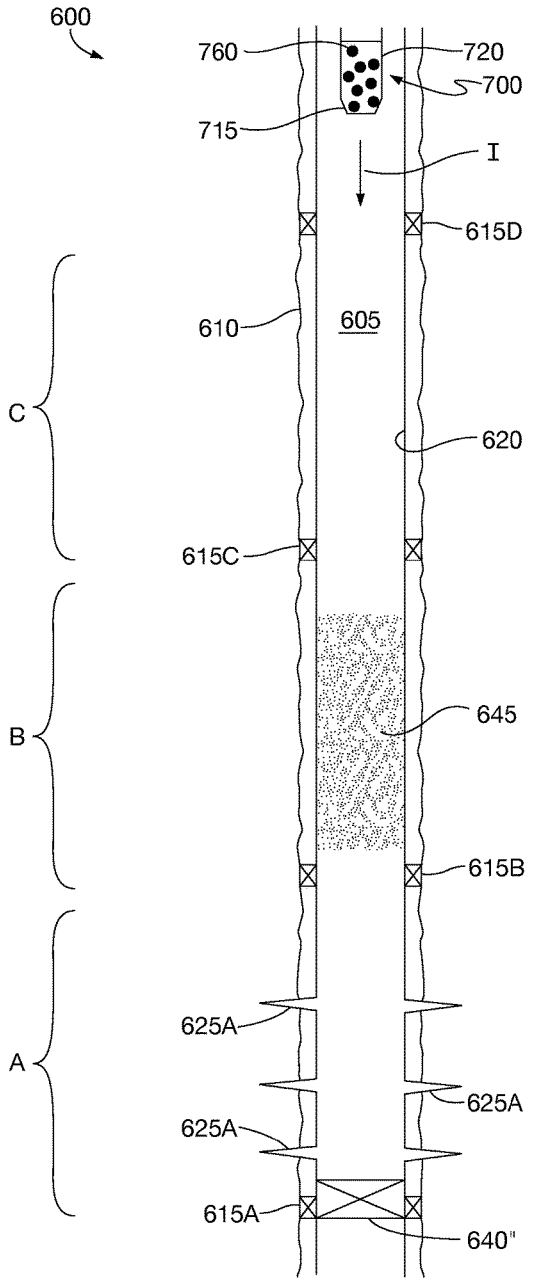

FIG. 6C shows Zone A having been perforated. The perforating gun 650 has disintegrated and is no longer visible. Simultaneously, or immediately thereafter, a fracturing fluid 645 is being pumped into the wellbore 600, with a new autonomous completion assembly 700 being released into the wellbore 600 behind the fracturing fluid 645. A leading tip 715 of the assembly 700 is visible in FIG. 6C.

Figure 6D:
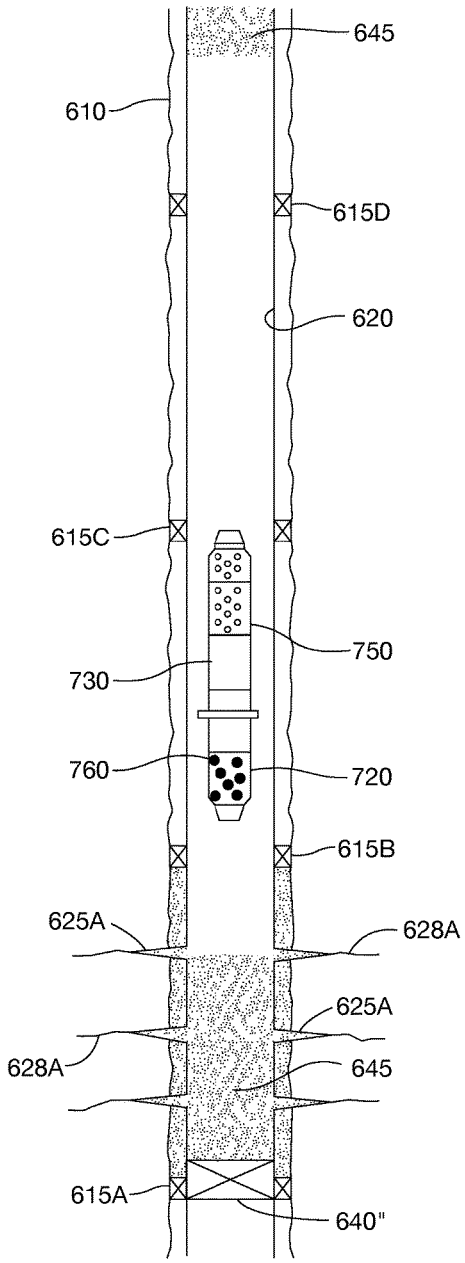
Figure 7:
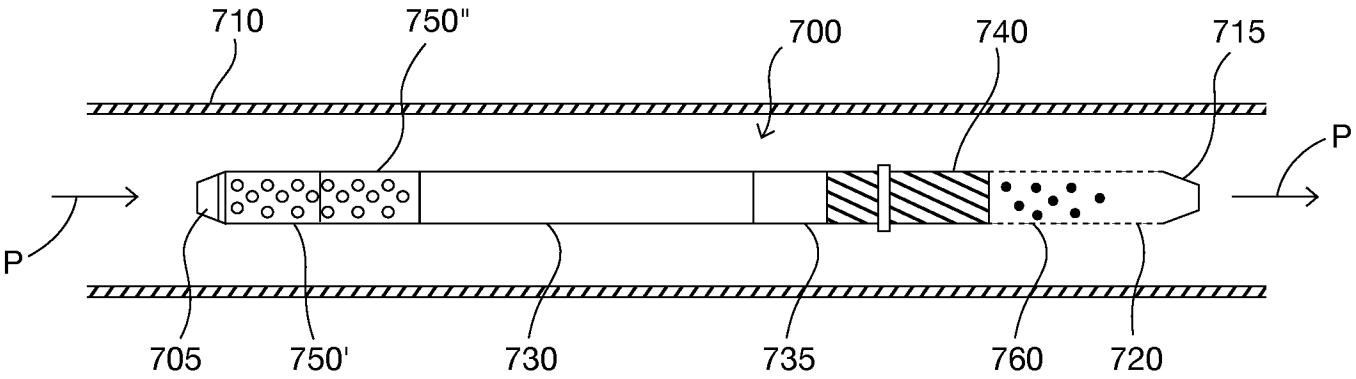
FIG. 7 is a side view of an autonomous completion assembly of the present invention, in one embodiment. The completion assembly is used for perforating a zone along a wellbore without being electrically tethered to or receiving wired instructions immediately from the surface.

FIG. 7 is a side view of the autonomous completion assembly 700 of FIG. 6C (and FIG. 6D), in one embodiment. The completion assembly 700 is used for perforating a zone along a wellbore without being tethered to or receiving wired instructions from the surface.

As with the autonomous perforating assembly 670 of FIG. 6B, the autonomous completion assembly 700 includes a perforating gun 750. In the arrangement of FIG. 7, the assembly 700 includes two separate perforating guns, indicated at 750' and 750". This reserves the ability of the assembly to fire separate sets of charges in response to separate activation signals.

The autonomous assembly 700 defines an elongated body having a leading end 715 and a trailing end 705. The assembly 700 is preferably fabricated from a material that is frangible. In this respect, it is designed to disintegrate when charges associated with the perforating guns 750 are detonated.

The assembly 700 also includes a casing collar locator 740, known in the industry as a "CCL." The CCL senses the location of the casing collars as it moves down the casing string 620. While FIG. 7 presents the position locator 740 as a CCL for sensing casing collars, it is understood that other sensing arrangements may be employed in the completion assembly 700. For example, the position locator may be a radio frequency detector, and the sensed objects may be radio frequency identification tags, or "RFID" devices. In this arrangement, the tags may be placed along the inner diameters of selected casing joints, and the position locator will define an RFID antenna/reader that detects the RFID tags.

The CCL 740 measures magnetic flux as the assembly 700 falls through the wellbore 600. Anomalies in magnetic flux are interpreted as casing collars residing along the length of the casing string 620. The assembly 700 is aware of its location in the wellbore 600 by counting collars along the casing string 620 as the assembly 700 moves downward through the wellbore 600.

The autonomous assembly 700 also includes a canister 720. The canister 720 is configured to hold a plurality of ball sealers 760. In one embodiment, the canister 720 additionally holds a treating fluid such as an acid or a resin.

The autonomous assembly 700 also includes an on-board controller 730. The on-board controller 730 is programmed to send at least two signals. A first signal is sent to the canister 720 when the assembly 670 has reached a selected location along the wellbore 600. That signal causes the ball sealers 760 to be released. This may be done, for example, by opening a valve. A second signal is sent to the perforating gun 750.

The autonomous assembly 700 may also include a power supply 735. The power supply 735 may be, for example, one or more lithium batteries, or battery pack. The power supply 735 will reside in a housing along with the on-board controller 730. The perforating gun 750, the location device 740, the on-board controller 730 and the battery pack 735 are together dimensioned and arranged to be deployed in a wellbore as an autonomous unit.

Referring now to FIG. 6D, FIG. 6D shows the fracturing fluid 645 having been pumped through the perforations in Zone A. Artificial fractures 628A have been induced in the subsurface formation 610 along Zone A. Simultaneously, the autonomous completion assembly 700 of FIG. 6C has fallen to a location along Zone B. The assembly 700 is in position to fire a new set of perforations, seamlessly.

It is again observed that the assembly 700 is designed to be frangible. Thus, after the firing step in FIG. 6D, the assembly 700 will no longer be visible. A new completion assembly will be dropped for Zone B.

Figure 6E:
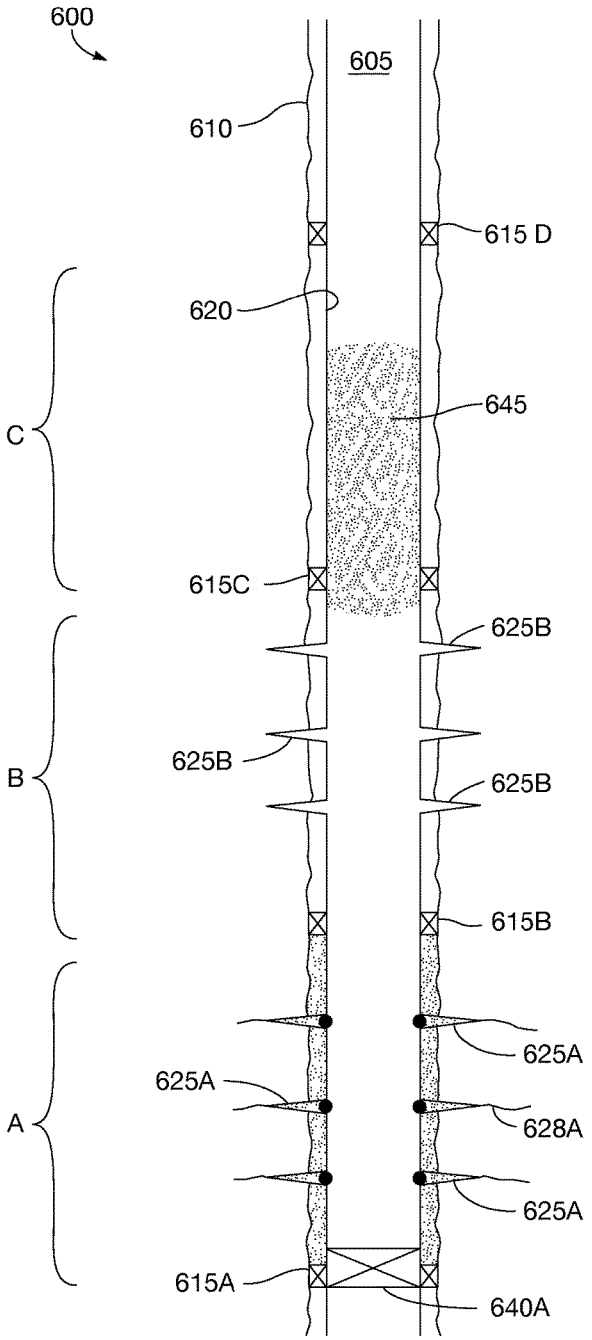

FIG. 6E shows a next step in a multi-zone completion process. Here, the ball sealers 760 from the assembly 700 of FIG. 6D (that is no longer present) have landed in the perforations 625A along Zone A. Additionally, the perforating gun 700 of FIG. 6D has fired, creating fractures 625B along Zone B. A new fracturing fluid 645 is now being pumped in the wellbore 600 in anticipation of treating Zone B.

Figure 6F:
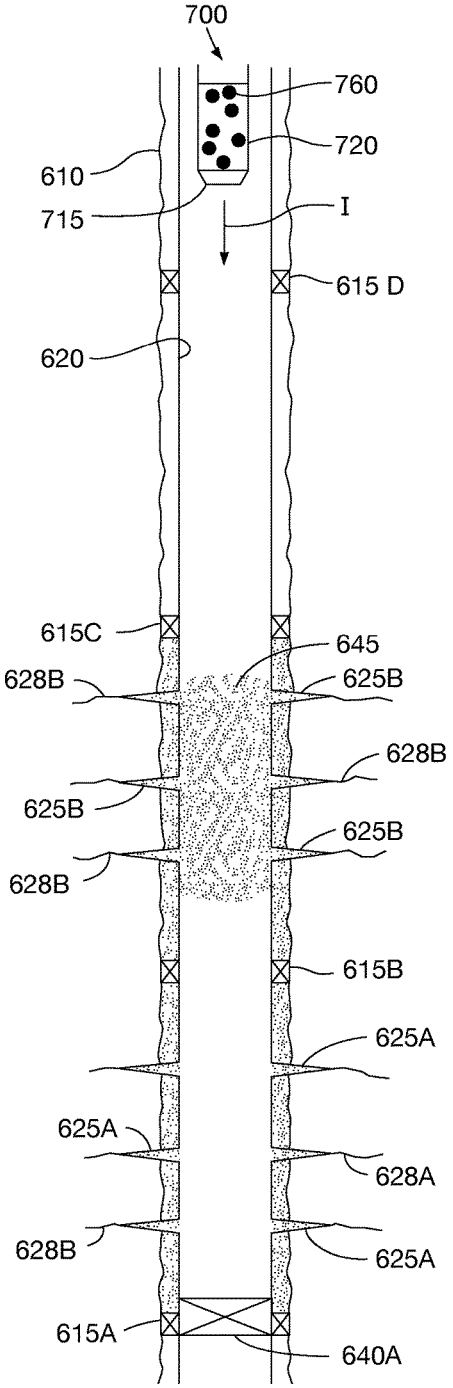

FIG. 6F shows the fracturing fluid 645 of FIG. 6E now being pumped into the perforations 625B along Zone B. Artificial fractures 628B are being formed along Zone B. Simultaneously, a new autonomous completion assembly 700 has been released into the wellbore 600 in anticipation of creating perforations along Zone C.

It can be seen that the completion assembly 700 allows for the perforation and fracturing of multiple zones along a wellbore without requiring work stoppage to pull or to change out tools. The completion assembly 700 is autonomous, meaning that it is not electrically controlled from the surface for receiving activation signals.

The completion assembly 700 is preferably equipped with a special tool-locating algorithm. The algorithm allows the tool to accurately track casing collars en route to a selected location downhole. U.S. patent application Ser. No. 13/989,726 filed on Dec. 27, 2010 discloses a method of actuating a downhole tool in a wellbore, published as U.S. Patent Publ.

No. 2013/0255939, entitled "Method for Automatic Control and Positioning of Autonomous Downhole Tools".

U.S. Patent Publ. No. 2013/0255939 discloses and discusses the tool-locating algorithm. According to that disclosure, the operator will first acquire a CCL data set from the wellbore. This is preferably done using a traditional casing collar locator. The casing collar locator is run into a wellbore on a wireline or electric line to detect magnetic anomalies along the casing string. The CCL data set correlates continuously recorded magnetic signals with measured depth. More specifically, the depths of casing collars may be determined based on the length and speed of the wireline pulling a CCL logging device. In this way, a first CCL log for the wellbore is formed.

The application also includes selecting a location within the wellbore for actuation of an actuatable tool. In the completion assembly 700, two separate actuatable tools are provided. These are the canister that releases ball sealers, and the perforating gun that detonates charges.

In practice, the first CCL log is downloaded into a processor. The processor is part of the on-board controller 730. The on-board controller 730 processes the depth signals generated by the casing collar locator 740. In one aspect, the on-board controller 730 compares the generated signals from the position locator 740 with a pre-determined physical signature obtained for wellbore objects from the prior CCL log.

The on-board controller 730 is programmed to continuously record magnetic signals as the autonomous tool 700 traverses the casing collars. In this way, a second CCL log is formed. The processor, or on-board controller 730, transforms the recorded magnetic signals of the second CCL log by applying a moving windowed statistical analysis. Further, the processor incrementally compares the transformed second CCL log with the first CCL log during deployment of the downhole tool to correlate values indicative of casing collar locations. This is preferably done through a pattern matching algorithm. The algorithm correlates individual peaks or even groups of peaks representing casing collar locations. In addition, the processor is programmed to recognize the selected location in the wellbore, and then send an activation signal to the actuatable wellbore device or tool when the processor has recognized the selected location.

In some instances, the operator may have access to a wellbore diagram providing exact information concerning the spacing of downhole markers such as the casing collars. The on-board controller 216 may then be programmed to count the casing collars, thereby determining the location of the tool as it moves downwardly in the wellbore.

In some instances, the production casing 620 may be pre-designed to have so-called short joints, that is, selected joints that are only, for example, 15 feet, or 20 feet, in length, as opposed to the "standard" length selected by the operator for completing a well, such as 30 feet. In this event, the on-board controller 730 may use the non-uniform spacing provided by the short joints as a means of checking or confirming a location in the wellbore as the completion assembly 700 moves through the casing 620.

In one embodiment, the method further comprises transforming the CCL data set for the first CCL log. This also is done by applying a moving windowed statistical analysis. The first CCL log is downloaded into the processor as a first transformed CCL log. In this embodiment, the processor incrementally compares the second transformed CCL log with the first transformed CCL log to correlate values indicative of casing collar locations.

In one embodiment, the algorithm interacts with an on-board accelerometer. An accelerometer is a device that measures acceleration experienced during a freefall. An accelerometer may include multi-axis capability to detect magnitude and direction of the acceleration as a vector quantity. When in communication with analytical software, the accelerometer allows the position of an object to be confirmed.

Additional details for the tool-locating algorithm are disclosed in U.S. Patent Publ. No. 2013/0255939, referenced above. That related, co-pending application is incorporated by reference herein in its entirety.

It is also desirable with the autonomous completion assembly 700 to include various safety features that prevent the premature actuation or firing of the perforating guns 750', 750". These are in addition to the locator device 730 and the on-board controller 740 described above. Preferably, each autonomous completion assembly 700 utilizes at least two, and preferably at least three, safety gates or "barriers" that must be satisfied before the perforating gun 750 may be armed.

Figure 8:
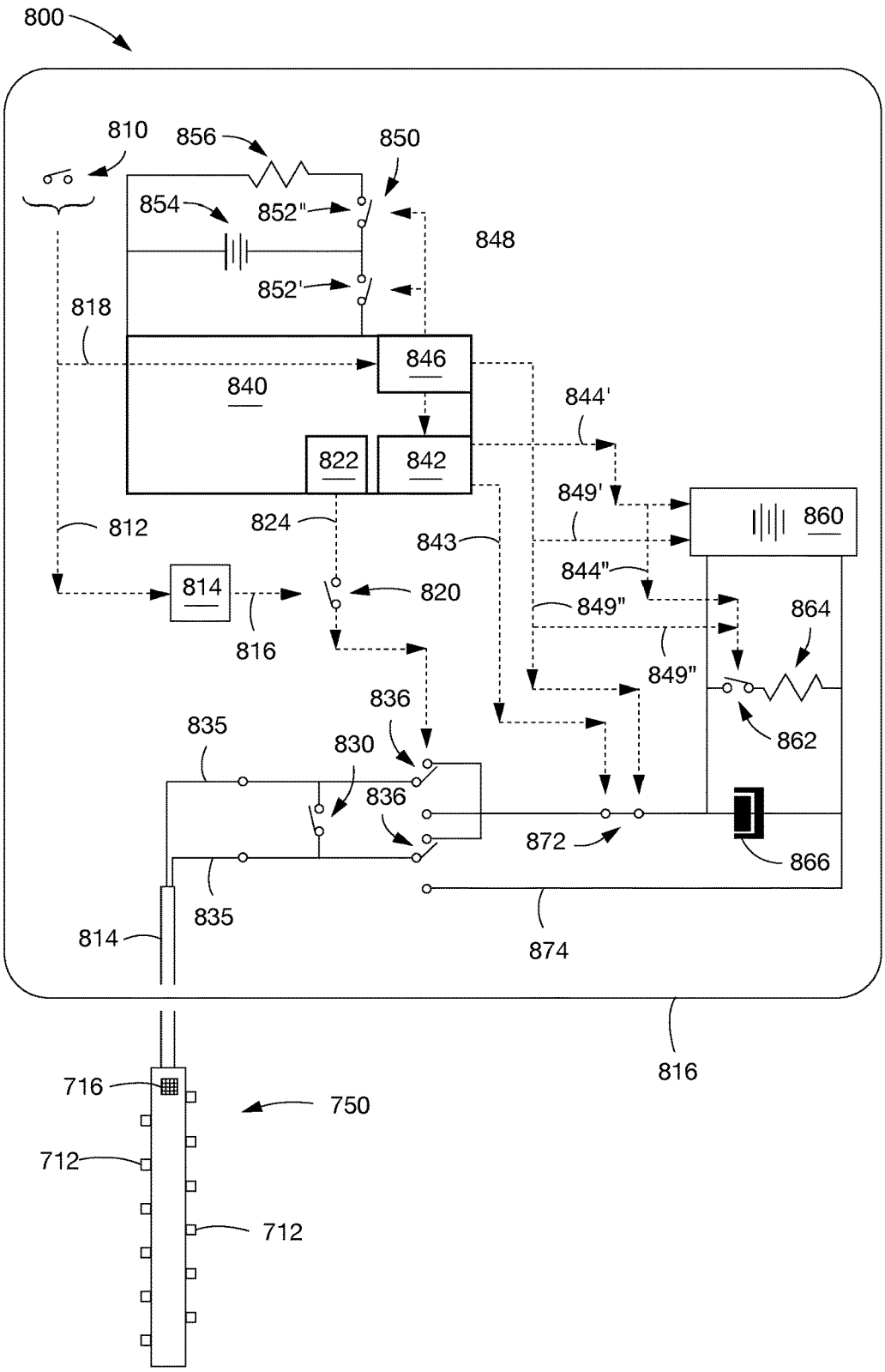
FIG. 8 schematically illustrates a multi-gated safety system for an autonomous wellbore tool, in one embodiment.

FIG. 8 schematically illustrates a multi-gated safety system 800 for an autonomous wellbore tool, in one embodiment. In the safety system 800 of FIG. 8, five separate gates are provided. The gates are indicated at 810, 820, 830, 840, and 850. Each of these illustrative gates 810, 820, 830, 840, 850 represents a condition that must be satisfied in order for detonation charges 712 to be activated. Stated another way, the gated safety system 800 keeps detonators 716 inactive while the completion assembly 700 and its perforating guns 850', 850" are at the surface or is in transit to a well site.

Using the gates 810, 820, 830, 840, 850, electrical current to detonators 716 is initially shunted to prevent detonation of charges 712 caused by stray currents. In this respect, electrically actuated explosive devices can be susceptible to detonation by stray electrical signals. These may include radio signals, static electricity, or lightning strikes. After the assembly is launched, the gates are removed. This is done by un-shunting the detonator by operating an electrical switch, and by further closing electrical switches one by one until an activation signal may pass through the safety circuit and the detonators 716 are active.

In FIG. 8, a perforating gun is seen schematically at 750. The perforating gun 750 includes a plurality of shaped charges 712. The charges 712 are distributed along the length of the gun 850. The charges 712 are ignited in response to an electrical signal delivered from a controller 816 through electrical lines 835 and to the detonators 716. The lines 835 are bundled into a sheath 814 for delivery to the perforating gun 750 and the detonators 716. Optionally, the electrical lines (shown at 835) are pulled from inside the completion assembly 700 as a safety precaution until the assembly 700 is delivered to a well site.

The detonators 716 receive an electrical current from a firing capacitor 866. The detonators 716 then deliver heat to the primer cord, which in turn fires the charges 712 to create the perforations. Electrical current to the detonators 716 is initially shunted to prevent detonation from stray currents. In this respect, electrically actuated explosive devices can be susceptible to detonation by stray electrical signals. These may include radio signals, static electricity, or lightning strikes. After the assembly 700 is launched, the gates are removed. This is done by un-shunting the detonators 716 by operating an initial electrical switch (seen at gate 810), and by further closing electrical switches one by one until an activation signal may pass through the safety circuit 800 and the detonators 716 are active.

In the arrangement of FIG. 8, two physical shunt wires 835 are provided. Initially, the wires 835 are connected across the detonators 716. This connection is external to the perforating gun assembly 700. Wires 835 are visible from the outside of the assembly 700. When the assembly 700 is delivered to the well site, the shunt wires 835 are disconnected from one another and are connected to the detonators 716 and to the circuitry making up the safety system 800.

In operation, a detonation battery 860 is provided for the perforating gun 750. At the appropriate time, the detonation battery 860 delivers an electrical charge to a firing capacitor 866. The firing capacitor 866 then sends a strong electrical signal through one or more electrical lines 835. The lines 835 terminate at the detonators 716 within the perforating gun 750. The electrical signal generates resistive heat, which causes a detonation cord (not shown) to burn. The heating rapidly travels to the shaped charges 712 along the perforating gun 750.

In order to prevent premature actuation, and as noted above, a series of gates is provided. U.S. Ser. No. 61/489,165 describes a perforating gun assembly being released from a wellhead. That application was filed on 23 May 2011, and is entitled "Safety System for Autonomous Downhole Tool." The application was published as U.S. Publ. No. 2013/0248174. FIG. 8 and the corresponding discussion of the gates in that published application are incorporated herein by reference.

Without duplicating that full discussion, the gates are generally:

- A first gate 810, which is an optional pull tab mechanically removed by the crew at the well site;
- A second gate 820, which is a timed relay switch that shunts the electrical connections to the detonators 716 at all times unless a predetermined time value is exceeded;
- A third gate 830, which is based upon one or more pressure-sensitive switches;
- A fourth gate 840, which is an electronics module containing digital logic that determines the location of the gun assembly 700 as it traverses the wellbore by processing magnetic readings to identify probable casing collar locations, and compare those locations with a previously-downloaded (and, optionally algorithmically processed) casing collar log; and
- A fifth gate 850, which relates to the installation of a battery pack 854, meaning that the battery pack is not installed to power the controller of the fourth gate 840 until after the completion assembly 700 is at or near the well site. Without the controller, the firing capacitor cannot deliver electrical signals through the wires 835 and the detonators 716 cannot be armed.

In a related embodiment, the completion assembly 700 may include a button or other user interface that allows an operator to manually "arm" the perforating gun 750. The user interface is in electrical communication with a timer within the on-board controller 730. For example, the timer might be 2 minutes. This means that the perforating gun 750 cannot fire for 2 minutes from the time of arming. Here, the operator must remember to manually arm the perforating gun 750 before releasing the assembly into the wellbore 600.

Preferably, the safety system 800 is also programmed or designed to de-activate the detonators 716 in the case that detonation does not occur within a specified period of time. For instance, if the detonators 716 have not caused the charges 712 to fire after 55 minutes, the electrical switch representing the second gate 820 is opened, thereby preventing the relay 836 from changing state from shunting the detonators 716 to connecting the detonators 716 to the firing capacitor 866. This feature enables the safe retrieval of the gun assembly 700 utilizing standard fishing operations. In any instance, a control signal is provided through dashed line 816 for operating the switch of the second gate 820.

The electronics module of the fourth gate 840 consists of an onboard memory 842 and built-in logic 844, together forming the controller. The electronics module provides a digital safety barrier based on logic and predetermined values of various tool events. Such events may include tool depth, tool speed, tool travel time, and downhole markers. Downhole markers may be Casing Collar Locator (CCL) signals caused by collars and pup joints intentionally (or unintentionally) placed in the completion string.

In the arrangement of FIG. 8, a signal 818 is sent when the launch switch representing the first gate 810 is closed. The signal 818 informs the controller to begin computing tool depth in accordance with its operational algorithm. The controller includes a detonator control 842. At the appropriate depth, the detonator control 842 sends a first signal 844' to the detonator power supply 860. In one aspect, the detonator power supply 860 is turned on a predetermined number of minutes, such as three minutes, after the completion assembly 700 is launched.

It is noted that in an electrically powered perforating gun, a strong electrical charge is needed to ignite the detonators 816. The power supply (or battery) 860 itself will not deliver that charge; therefore, the power supply 860 is used to charge the firing capacitor 866. This process typically takes about two minutes. Once the firing capacitor 866 is charged, the current lines 835 may carry the strong charge to the detonators 816. Line 874 is provided as a power line.

The controller of the fourth gate 840 also includes a fire control 822. The fire control 822 is part of the logic. For example, the program or digital logic representing the fourth gate 840 locates the perforating zone by matching a reference casing collar log using real time casing collar information acquired as the tool drops down the well. When the perforating gun assembly 700 reaches the appropriate depth, a firing signal 824 is sent.

The fire control 822 is connected to a 2-pole Form C fire relay 836. The fire relay 836 is controlled through a command signal shown at 824. The fire relay 836 is in a shunting of detonators 716 (or safe) state until activated by the fire control 822, and until the command path 824 through the second gate 820 is available. In their safe state, the fire relay 836 disconnects the up-stream power supply 860 and shunts down-stream detonators 816. The relay 836 is activated upon command 824 from the fire control 822.

As an alternative to any of gates 810, 820, 830 or 850, a vertical position indicator may be used as a safety check. This means that the on-board controller 730 will not provide a signal to the perforating gun 750 to fire until the vertical position indicator confirms that the completion assembly 700 is oriented in a substantially vertical orientation, e.g., within five degrees of vertical. For example, the vertical position indicator may be a mercury tube that is in electrical communication with the on-board controller. Of course, this safety feature only works where the wellbore 600 is being perforated or the tool 700 is being actuated along a substantially vertical zone of interest. Thus, this type of safety check is not shown in FIG. 8.

In yet another alternative, a safety check may be utilized that involves a velocity calculation. In this instance, the perforating gun assembly 700 may include a second locator device spaced some distance below the original locator device. As the assembly 700 travels across casing collars, signals generated by the second and the original locator devices are timed. The velocity of the assembly is determined by the following equation:

$$D/(T_2-T_0)$$

Where: $T_o$=Time stamp of the detected signal from the original locator device;

$T_2$=Time stamp of the detected signal from a second locator device; and

D=Distance between the original and second locator devices.

Use of such a velocity calculation ensures both a depth and the present movement of the perforating gun assembly before the firing sequence can be initiated.

In operation, the battery pack (Gate 5) is installed into the perforating gun 750. The gun 750 is then released into the wellbore. The ring removal (Gate 1) triggers a pressure-activated switch (Gate 2) rated to remove the detonator shunt at a predetermined pressure value. In addition, the ring removal (Gate 1) activates a timed relay switch (Gate 3) that removes another detonator shunt once the pre-set time expires. At this point, the detonators 716 are ready to fire and await the activation signal from the control system (the Gate 4 electronics module). The electronics module monitors the depth of the gun assembly 700. After the completion assembly 700 has traveled to a pre-programmed depth, the electronics logic (Gate 4) sends a signal that closes a mechanical relay and initiates detonation.

Additional features of the circuit 800 for the multi-gated safety system are disclosed in the referenced U.S. incorporated patent application that is U.S. Patent Publ. No. 2013/0248174.

Figure 9A:
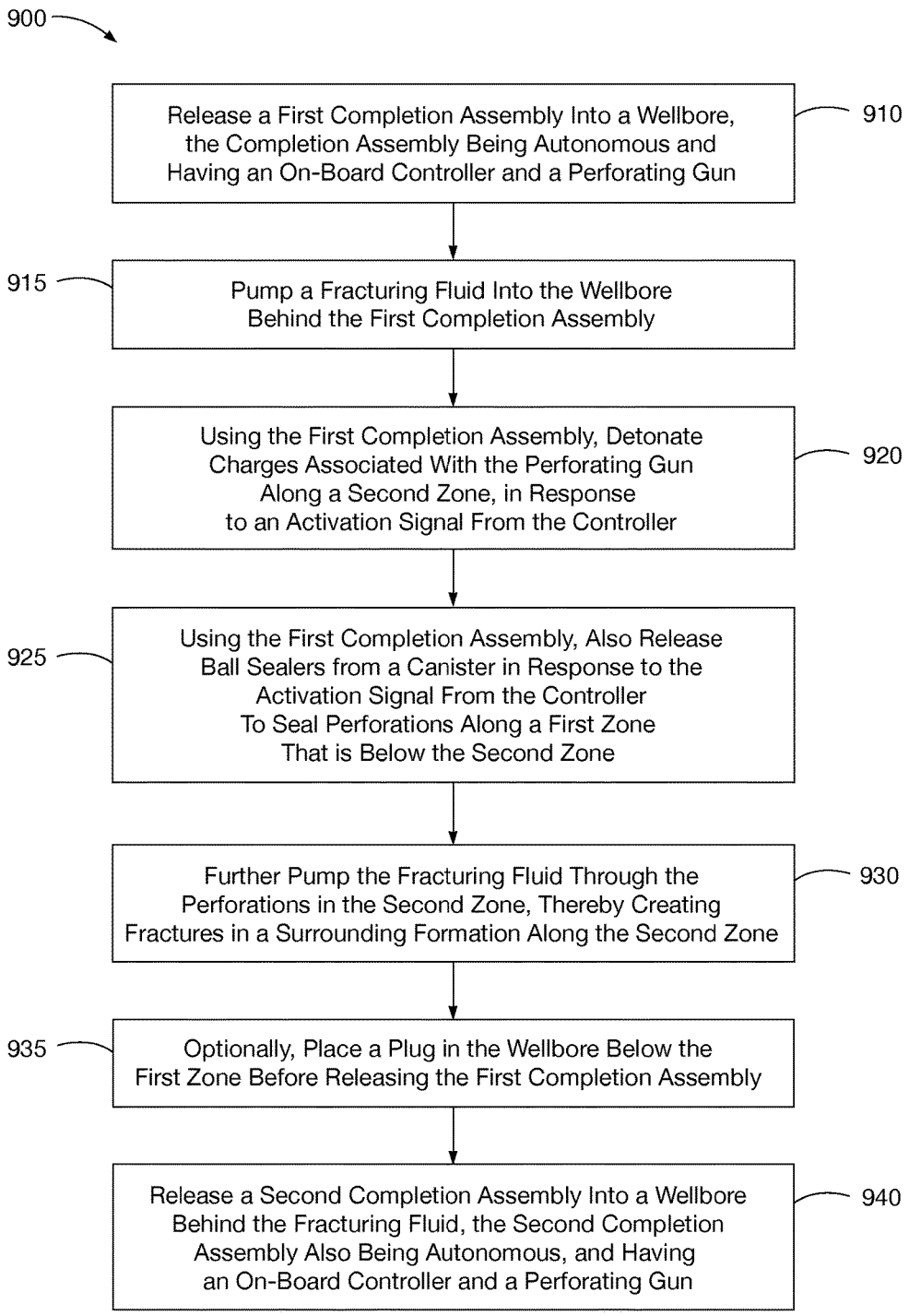
FIGS. 9A and 9B are a single flow chart showing steps for a method of perforating multiple zones along a wellbore, in one embodiment. The method uses the autonomous completion assembly of FIG. 7 and ball sealers in a seamless manner.
Figure 9B:
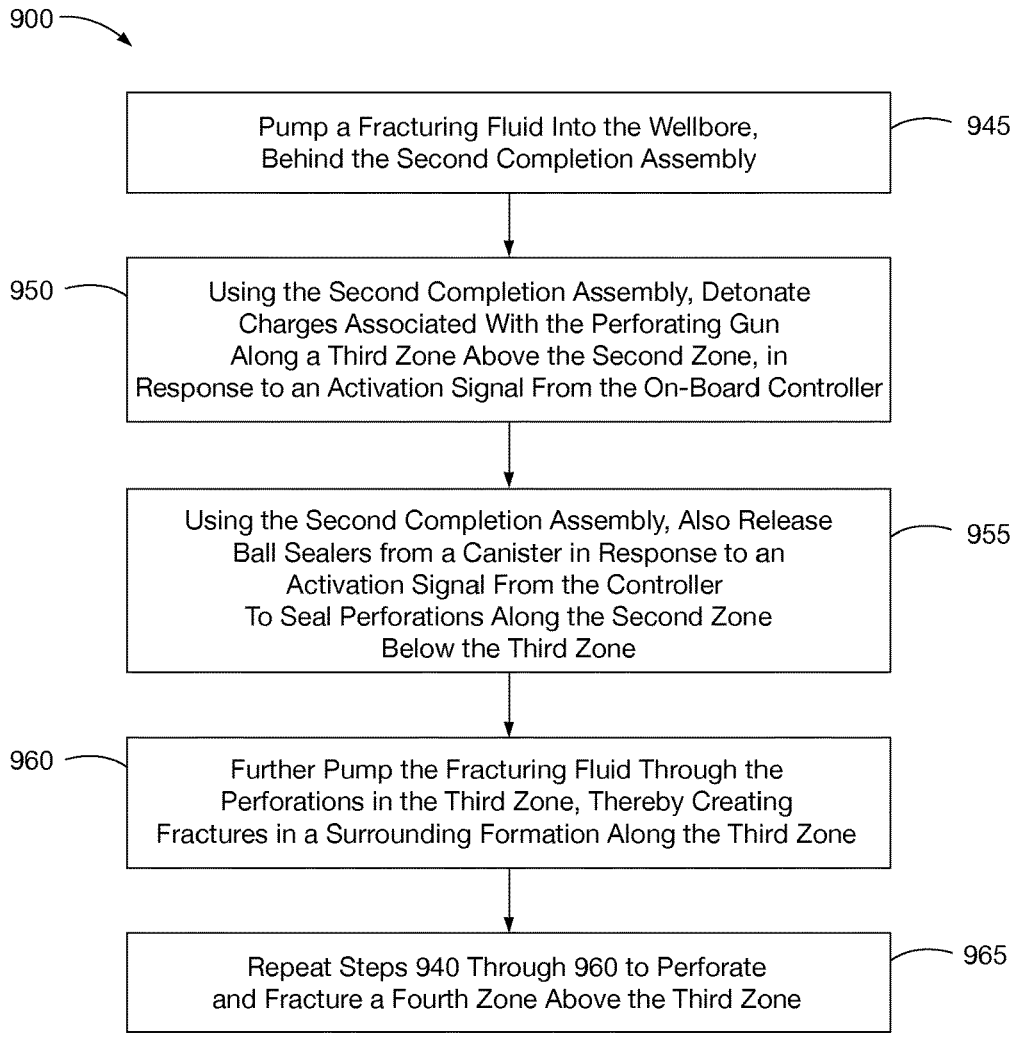

FIGS. 9A and 9B represent a flow chart showing steps for a method 900 of perforating multiple zones along a wellbore, in one embodiment. The method 900 uses the autonomous completion assembly 700 of FIG. 7 for multi-zone fracturing in a seamless manner.

The method 900 first includes releasing a first completion assembly into the wellbore. This is shown at Box 910. The first completion assembly is designed in accordance with the completion assembly for autonomously perforating a section of casing as described above, in its various embodiments. In this respect, the assembly includes a perforating gun, a canister containing a plurality of ball sealers, a casing collar locator, and an on-board controller. A battery pack may be included to power the on-board controller. The perforating gun, the canister, the locator, and the on-board controller are together dimensioned and arranged to be deployed in the wellbore as a first autonomous unit.

The method 900 also includes pumping a fracturing fluid into the wellbore. This is provided at Box 915. The fluid is pumped behind the first completion assembly.

The method 900 next includes detonating charges associated with the perforating gun of the first completion assembly. This is shown at Box 920. The charges detonate in response to an actuation signal from the on-board controller when the locater has recognized a selected location of the completion assembly. More specifically, the signal causes a "cap" to be fired, which ignites (or heats) a primer cord, which in turn fires the perforating gun. In this way, the casing is perforated at the selected location as a second zone.

The method 900 additionally includes releasing a plurality of ball sealers from the canister. This is indicated at Box 925. The ball sealers are also released in response to an actuation signal sent by the on-board controller when the locator has recognized a selected location of the completion assembly. Preferably, firing of the perforating guns is accompanied by a complete fragmentation of the completion assembly, causing the ball sealers to be released. The charge is designed to fragment the entire tool assembly into the smallest pieces possible. The ball sealers fall down the wellbore and then seal perforations existing in a first zone below the selected location.

In one aspect, releasing the ball sealers of Box 920 also causes a fluid to be released. The fluid may be an acid such as hydrochloric or fluoric acid. Alternatively, the acid may be a pre-cursor. Alternatively still, the fluid may be a diverter such as a polymer.

In another aspect, a fluid container is provided in the completion assembly. The fluid container comprises a valve having at least one port. The valve is configured to open the at least one port in response to a signal sent from the on-board controller. Alternatively, the fluid is released when the assembly is fragmented.

The method 900 also includes further pumping the fracturing fluid through the perforations in the second zone. This is provided at Box 930. The fracturing fluid is pumped under pressure in order to creating artificial fractures in a surrounding formation. Preferably, the fracturing fluid comprises a proppant such as sand.

In one embodiment of the method 900, the method 900 further comprises placing a plug in the wellbore below the first zone. This is given at Box 935. The plug is placed before fracturing fluid is pumped in the step of Box 915. Placing the plug in the step of Box 935 preferably includes actuating a set of slips associated with the plug.

In one aspect, the plug comprises a plug body having an expandable sealing element that is part of an autonomous perforating gun assembly. The autonomous perforating gun assembly has an on-board controller configured to (i) send a first actuation signal that causes the sealing element to expand when the locator has recognized the first selected location of the completion assembly, and (ii) send a second actuation signal to the perforating gun to cause detonators to fire after the plug body has seated, thereby perforating the casing along the first zone.

In another aspect, the expanded sealing element lands on a baffle along the wellbore at or below the first zone. Alternatively, the autonomous perforating gun assembly includes a set of slips that is actuated in response to the first signal.

In one embodiment, the method 900 also includes the steps of:

- releasing a second completion assembly into the wellbore (shown at Box 940);
- pumping a fracturing fluid into the wellbore behind the second completion assembly (shown at Box 945);
- detonating charges associated with the second perforating gun along a third zone above the second zone, thereby perforating the casing along the third zone (shown at Box 950);
- releasing ball sealers from the second completion assembly to seal perforations along the second zone (shown at Box 955); and
- further pumping the fracturing fluid through the perforations in the third zone, thereby creating additional fractures in a surrounding formation (shown at Box 960).

In this instance, the second completion assembly also includes a perforating gun, a canister containing a plurality of ball sealers that are dimensioned to seal perforations, a casing collar locator for sensing the location of the perforating gun within the wellbore based on the spacing of casing collars along the wellbore, and an on-board controller. Here, the on-board computer is configured to send an actuation signal to operatively fire the perforating gun when the locator has recognized a selected location of the completion assembly (Box 950), thereby perforating the casing at a third zone above the second zone. The actuation signal may also cause the canister to release the ball sealers, wherein the ball sealers then seal perforations existing in the second zone (Box 955).

It is preferred that the casing collar locator and the on-board controller operate with software in accordance with the locating algorithm discussed above. Specifically, the algorithm preferably employs a windowed statistical analysis for interpreting and converting magnetic signals generated by the casing collar locator. In one aspect, the on-board controller compares the generated signals with a pre-determined physical signature obtained for the wellbore objects. For example, a CCL log may be run before deploying the autonomous tool in order to determine the spacing of the casing collars. The corresponding depths of the casing collars may be determined based on the speed of the wireline that pulled the CCL logging device.

Preferably, the fracturing fluid begins to be pumped into the wellbore before the first actuation signal is sent to the canister of the second completion assembly. Preferably, the canister of each of the first and second completion assemblies is fabricated from a friable material such as ceramic. The canisters are then designed to self-destruct in response to the second actuation signal sent to the respective perforating guns. Alternatively, the canisters are designed to self-destruct in response to the first actuation signals such that destruction of the respective canisters causes the release of the respective ball sealers.

In one arrangement, the signal that releases the ball sealers involves opening a valve. Optionally, the canister holds a fluid such that opening the valve also releases the fluid before or simultaneously with detonating the charges.

In another arrangement, a packer resides between the first zone and the second zone. This serves to seal an annular region between the casing and a surrounding earth formation. The process of pumping proppant through the perforations formed in the various zone creates a sand pack in the annular region.

Finally, it is noted that the steps of Boxes 910 through 930, or the steps of Boxes 940 through 960, may be repeated to perforate and fracture a fourth zone above the third zone.

Figure 10A:
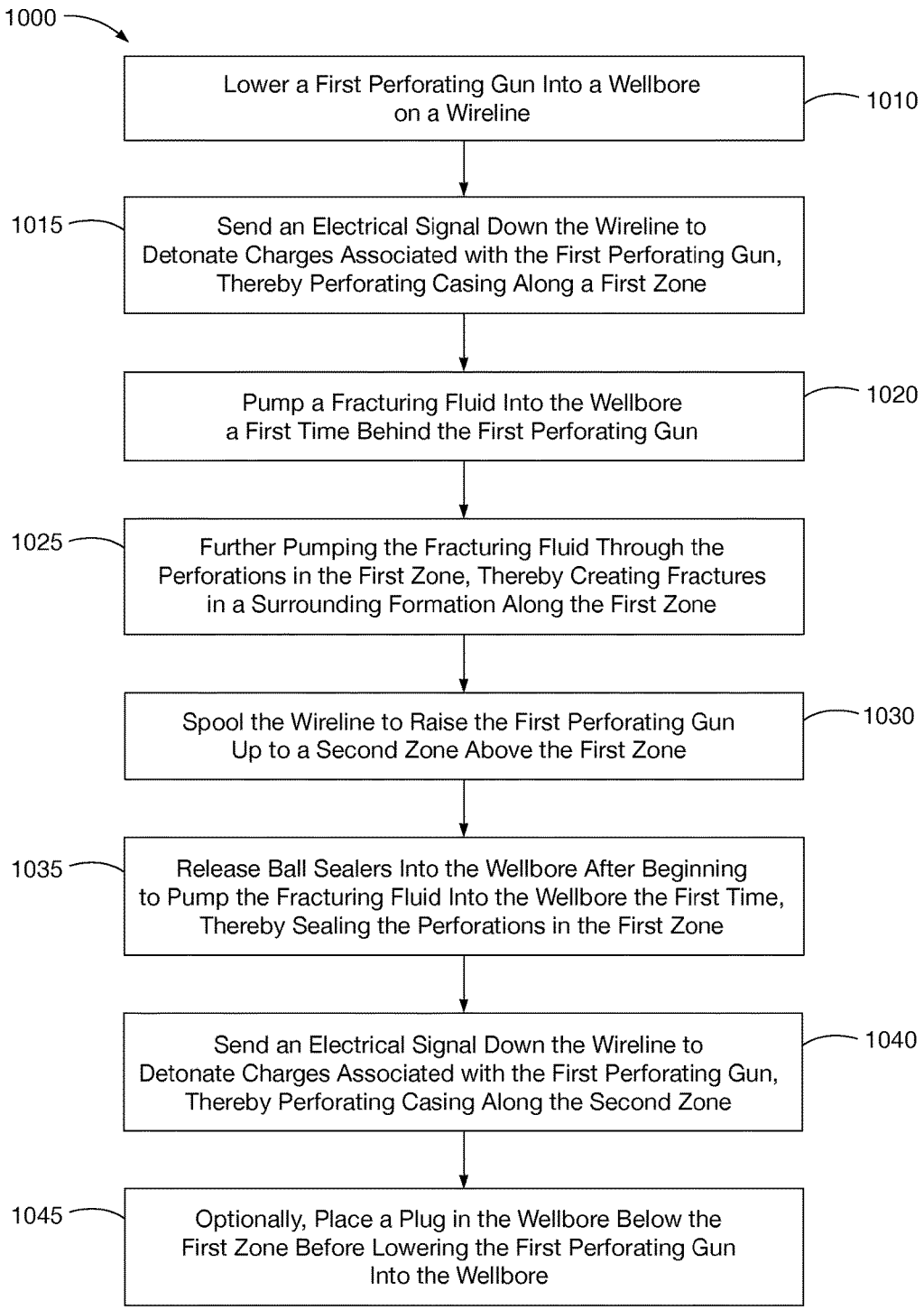
FIGS. 10A and 10B are a single flow chart showing steps for a method of perforating multiple zones along a wellbore, in an alternate embodiment. The method uses a perforating gun run into a wellbore on a wireline, and separate ball sealers, in a seamless manner.
Figure 10B:
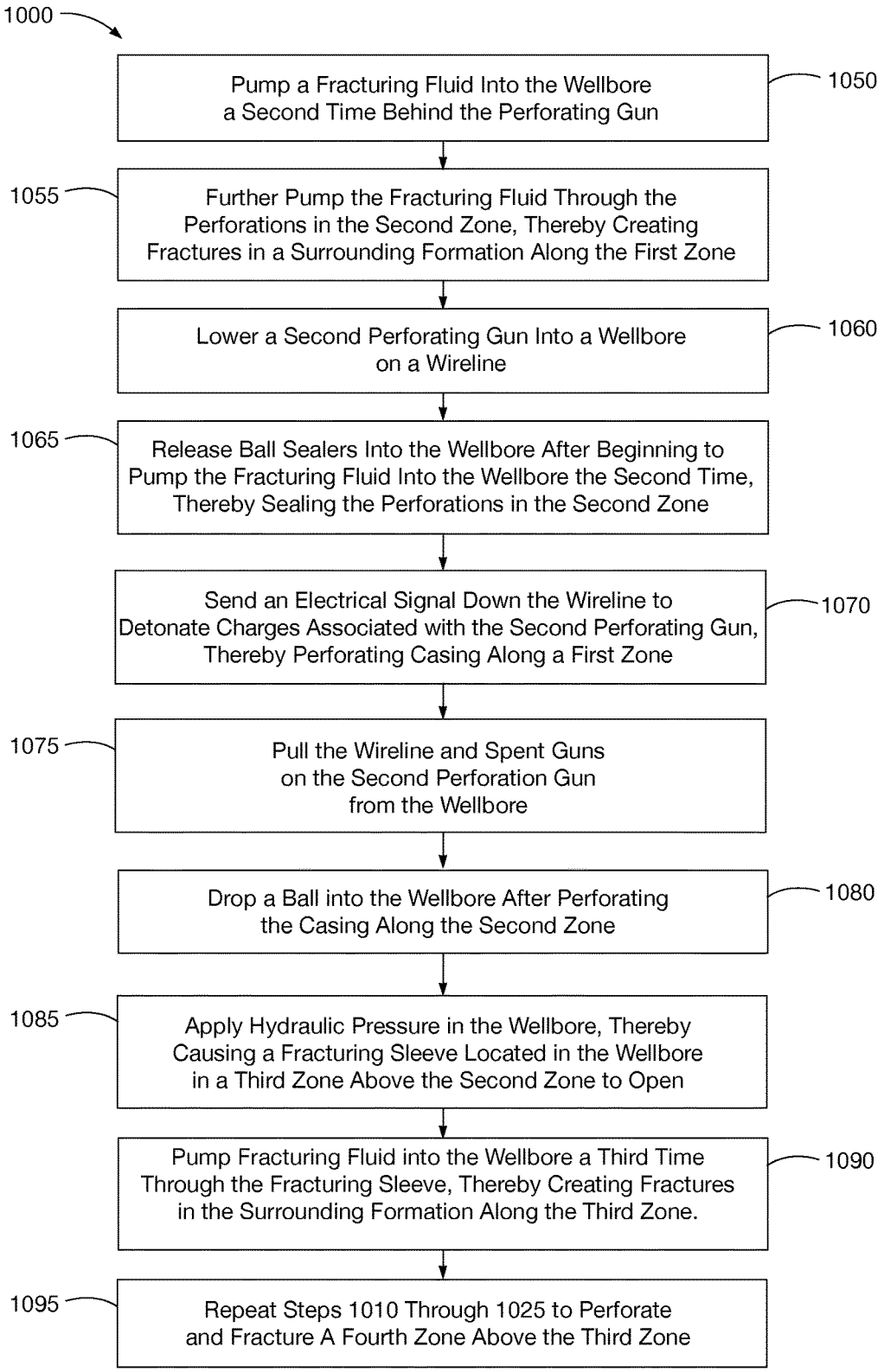

FIGS. 10A and 10B represent a flow chart showing steps for a method 1000 of perforating multiple zones along a wellbore, in an alternate embodiment. The method 1000 uses a perforating gun run into a wellbore on a wireline, and separate ball sealers for multi-zone fracturing in a seamless manner.

The method 1000 first includes lowering a first perforating gun into the wellbore. This is shown in Box 1010. The gun is lowered on a wireline.

The method 1000 next includes sending an electrical signal down the wireline to detonate charges associated with the first perforating gun. This is provided in Box 1015. The result is that perforations are formed in the casing along a first zone.

The method 1000 also includes pumping a fracturing fluid into the wellbore a first time. This is seen at Box 1020. The fluid is pumped behind the first perforating assembly. Preferably, the fracturing fluid comprises a proppant such as sand.

The method 1000 then includes further pumping the fracturing fluid through the perforations in the first zone. This is indicated at Box 1025. Pumping the fracturing fluid under pressure causes artificial fractures to form in a surrounding earth formation along the first zone.

The method 1000 additionally includes spooling the wireline in order to raise the first perforating gun up to a second zone. This is seen at Box 1030. The second zone resides above the first zone.

The method 1000 also includes releasing ball sealers into the wellbore. This is provided at Box 1035. The releasing step of Box 1035 is conducted after beginning to pump the fracturing fluid into the wellbore the first time. The result is that perforations in the first zone are sealed by the ball sealers.

The method 1000 then includes perforating the casing at a second zone that is above the first zone. This is shown at Box 1040. Perforating the casing is done by sending an electrical signal down the wireline to detonate charges associated with the first perforating gun.

In one embodiment of the method 1000, the method 1000 further comprises placing a plug in the wellbore below the first zone. This is given at Box 1045. The plug may be attached to the first perforating gun and is placed before the first perforating gun is fired (per Box 1025).

The method 1000 next provides pumping a fracturing fluid into the wellbore a second time. This is seen at Box 1050 in FIG. 10B. The fluid is pumped into the wellbore behind the first perforating gun. Preferably, the fracturing fluid comprises a proppant such as sand.

The method 1000 then comprises further pumping the fracturing fluid into the wellbore through the perforations in the second zone. This is provided at Box 1055. Pumping the fracturing fluid in under pressure creates additional fractures in the surrounding earth formation along the second zone.

The method 1000 also provides releasing ball sealers into the wellbore. This indicated at Box 1065. The releasing step of Box 1065 is conducted after beginning to pump the fracturing fluid into the wellbore the second time. The ball sealers are dimensioned to seal the perforations in the second zone.

In FIG. 10B, it can be seen that the step of Box 1060 provides for lowering a second perforating gun into the wellbore on a wireline. The method 1000 then includes sending an electrical signal down the wireline to detonate charges associated with the second perforating gun. This is shown in Box 1070. In this way, perforations are created in the casing at the second zone. This perforating step 1070 uses the second of a series of guns on the string in a procedure known as select-fire perforating.

It is observed that the steps of Boxes 1010 through 1040 may be repeated here in order to perforate and fracture additional zones above the second zone using the same perforating gun in a seamless manner. However, it is understood that the charges of the first perforating gun will be spent after two or three or even ten cycles. In the illustrative flow chart of FIGS. 10A and 10B, it is assumed that the perforating gun that has been lowered into the wellbore in the step of Box 1010 has actually already perforated multiple zones below the first zone. In any event, it is eventually necessary for the operator to pull the wireline and the first perforating gun from the wellbore. This is shown at Box 1075.

After the wireline and the first perforating gun are removed, a ball is dropped into the wellbore. This is given at Box 1080. The method 1000 then includes applying hydraulic pressure in the wellbore. This is shown at Box 1085. The application of hydraulic pressure causes a fracturing sleeve located in the wellbore in a third zone that is above the second zone to slide into its open position.

Once the frac sleeve is opened, the method 1000 includes pumping a fracturing fluid into the wellbore a third time through the fracturing sleeve. This is shown at Box 1090. Preferably, the steps of Boxes 1085 and 1090 are the same actions. In any event, the hydraulic pressure also creates fractures in the surrounding earth formation along the third zone.

The steps of Boxes 1010 through 1025 may be repeated to perforate and fracture additional zones above the third zone. This is indicated at Box 1095.

While it will be apparent that the inventions herein described are well calculated to achieve the benefits and advantages set forth above, it will be appreciated that the inventions are susceptible to modification, variation and change without departing from the spirit thereof.

What is claimed is:

1. An elongated completion assembly for autonomously perforating a section of casing in a wellbore, comprising:

a perforating gun;

a canister containing a plurality of ball sealers that are dimensioned to seal perforations;

a casing collar locator for sensing the location of the perforating gun within the wellbore based on the spacing of casing collars along the wellbore; and an on-board controller powered by a battery pack and configured to send a first actuation signal to the perforating gun to cause one or more detonators to fire when the locator has recognized a selected location of the completion assembly along the wellbore, thereby perforating the casing at a second zone, and to release the ball sealers from the canister for sealing perforations at a first zone below the second zone;

a multi-gate safety system electrically engaged with the on-board controller for preventing premature activation of the perforating gun, the safety system comprising control circuitry having one or more electrical switches that are independently operated in response to separate conditions before permitting the actuation signal to reach the tool; and wherein the perforating gun, the canister, the locator, and the on-board controller are together dimensioned and arranged to be deployed in the wellbore as an autonomous unit; and the canister is a fluid container; and the actuation signal further causes a fluid to be released from the fluid container along with the ball sealers.

2. The completion assembly of claim 1, wherein:

the canister is fabricated from a friable material; and the ball sealers are released in response to fragmentation of the canister.

3. The completion assembly of claim 2, wherein:

the completion assembly is designed to self-destruct in response to the first actuation signal sent to the perforating gun, or in response to a separate second actuation signal.

4. The completion assembly of claim 1, wherein:

the location device comprises a pair of sensing devices spaced apart along the completion assembly as lower and upper sensing devices;

the controller comprises a clock that determines time that elapses between sensing by the lower sensing device and sensing by the upper sensing device as the delivery assembly traverses across a casing collar; and the delivery assembly is programmed to determine delivery assembly velocity at a given time based on the distance between the lower and upper sensing devices, divided by the elapsed time between sensing.

5. The completion assembly of claim 1, wherein a position of the completion assembly at the selected location along the wellbore is confirmed by a combination of (i) location of the assembly relative to the collars as sensed by either the lower or the upper sensing device, and (ii) velocity of the assembly as computed by the controller as a function of time.

6. The completion assembly of claim 1, wherein the fluid comprises an acid or a polymer.

7. The completion assembly of claim 6, wherein:

the fluid container comprises a valve having at least one port, with the valve being configured to open the at least one port in response to the actuation signal sent from the on-board controller.

8. The completion assembly of claim 1, wherein the multi-gate safety system comprises at least one of:

(i) a selectively removable battery pack, wherein the control circuitry is configured to operate an electrical switch when the battery pack is installed into the assembly;

(ii) a mechanical pull-tab, wherein the control circuitry is configured to operate an electrical switch upon removal of the tab from the perforating gun;

(iii) a pressure-sensitive switch that is configured to operate an electrical switch only when a designated hydraulic pressure on the completion assembly is exceeded;

(iv) an electrical timer switch that is configured to operate only a designated period of time after deployment of the completion assembly in the wellbore;

(v) a velocity sensor configured to operate an electrical switch only upon sensing that the completion assembly is traveling at a designated velocity; and (vi) a vertical sensor configured to operate an electrical switch when the completion assembly is substantially vertical;

wherein operating an electrical switch means either closing such a switch to permit a flow of electrical current through the switch, or opening such a switch to restrict a flow of electrical current through the switch.

9. The completion assembly of claim 1, wherein the ball sealers are fabricated from a dissolvable material.

10. A method for perforating multiple zones along a wellbore, the wellbore having been completed with one or more strings of casing, comprising:

providing perforations in a first zone within the wellbore and pumping a fracturing fluid into the perforations in the first zone;

releasing a first completion assembly into the wellbore, the first completion assembly comprising:

a perforating gun;

a canister containing a plurality of ball sealers that are dimensioned to seal perforations;

a casing collar locator for sensing the location of the perforating gun within the wellbore based on the spacing of casing collars along the wellbore; and an on-board controller powered by a battery pack and configured to send a first actuation signal to the perforating gun to cause one or more detonators to fire when the locator has recognized a first selected location of the completion assembly along the wellbore, thereby perforating the casing at a second zone, and to release ball sealers from the canister;

a multi-gate safety system electrically engaged with the on-board controller for preventing premature activation of the perforating gun, the multi-gate safety system comprising control circuitry having one or more electrical switches that are independently operated in response to separate conditions before permitting the actuation signal to reach the tool; and wherein the perforating gun, the canister, the locator, and the on-board controller are together dimensioned and arranged to be deployed in the wellbore as a firs t autonomous unit;

wherein the canister is a fluid container; and wherein the actuation signal further causes a fluid to be released from the fluid container along with the ball sealers; and pumping the fracturing fluid into the wellbore behind the first completion assembly;

perforating the casing at the second zone using the perforating gun of the first completion assembly;

sealing perforations in the first zone below the second zone using the ball sealers released from the first completion assembly; and further pumping the fracturing fluid through the perforations in the second zone, thereby creating fractures in a surrounding formation.

11. The method of claim 10, wherein the fracturing fluid comprises a proppant.

12. The method of claim 11, wherein:

the proppant comprises sand;

a packer resides between the first zone and the second zone, thereby sealing an annular region between the casing and a surrounding earth formation; and the process of pumping proppant through the perforations formed in the first zone creates a sand pack in the annular region.

13. The method of claim 10, wherein:

the canister is fabricated from a friable material; and the ball sealers are released in response to fragmentation of the canister.

14. The method of claim 13, wherein:

the first completion assembly is designed to self-destruct in response to the first actuation signal sent to the perforating gun, or in response to a separate second actuation signal.

15. The method of claim 14, wherein the fracturing fluid begins to be pumped into the wellbore before the first actuation signal is sent.

16. The method of claim 14, further comprising:

releasing a second completion assembly into the wellbore after releasing the first completion assembly, the second completion assembly also comprising:

a perforating gun;

a canister containing a plurality of ball sealers that are dimensioned to seal perforations;

a casing collar locator for sensing the location of the perforating gun within the wellbore based on the spacing of casing collars along the wellbore; and an on-board controller configured to send a first actuation signal to the perforating gun to cause one or more detonators to fire when the locator has recognized a second selected location of the completion assembly along the wellbore, thereby perforating the casing at a third zone above the second zone, and to release ball sealers from the canister;

a multi-gate safety system electrically engaged with the on-board controller for preventing premature activation of the perforating gun, the multi-gate safety system comprising control circuitry having one or more electrical switches that are independently operated in response to separate conditions before permitting the actuation signal to reach the tool; and wherein the perforating gun, the canister, the casing collar locator, and the on-board controller of the second completion assembly are together dimensioned and arranged to be deployed in the wellbore as an autonomous unit;

pumping the fracturing fluid into the wellbore behind the second completion assembly;

perforating the casing at the third zone using the perforating gun of the second completion assembly;

sealing perforations in the second zone using the ball sealers released from the second completion assembly; and further pumping the fracturing fluid through the perforations in the third zone, thereby creating additional fractures in a surrounding formation.

17. The method of claim 16, wherein:

the canister of the second completion assembly is fabricated from a friable material;

the ball sealers of the second completion assembly are released in response to fragmentation of the canister; and the second completion assembly is designed to self-destruct in response to the first actuation signal sent to the perforating gun, or in response to a separate second actuation signal.

18. The method of claim 16, wherein the fracturing fluid begins to be pumped into the wellbore before the first actuation signal is sent to the canister of the second completion assembly.

19. The method of claim 16, further comprising:

placing a plug in the wellbore adjacent to or below the first zone before releasing the first completion assembly.

20. The method of claim 19, wherein:

the plug comprises a plug body having an expandable sealing element that is part of an autonomous perforating gun assembly; and the autonomous perforating gun assembly further comprises a perforating gun, a casing collar locator, and an on-board controller configured to:

(i) send a first actuation signal that causes the sealing element to expand when the locator has recognized the first selected location of the completion assembly, and (ii) send a second actuation signal to the perforating gun to cause detonators to fire after the plug body has seated, thereby perforating the casing along the first zone.

21. The method of claim 20, wherein (i) the expanded sealing element lands on a baffle along the wellbore at or below the first zone; or (ii) the autonomous perforating gun assembly further comprises a set of slips that are actuated also in response to the first signal.

* * * * *